US007443367B2

(12) United States Patent
Numao

(10) Patent No.: US 7,443,367 B2
(45) Date of Patent: Oct. 28, 2008

(54) DISPLAY DEVICE AND METHOD FOR DRIVING THE SAME

(75) Inventor: Takaji Numao, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 610 days.

(21) Appl. No.: 11/184,003

(22) Filed: Jul. 19, 2005

(65) Prior Publication Data

US 2006/0044244 A1 Mar. 2, 2006

(30) Foreign Application Priority Data

Sep. 1, 2004 (JP) ..... 2004-254615

(51) Int. Cl.
*G09G 3/30* (2006.01)

(52) U.S. Cl. ..... 345/76; 345/92

(58) Field of Classification Search ..... 345/36, 345/39, 41–42, 45–46, 48, 50–51, 55, 76–77, 345/81–84, 87–100, 204, 208–214; 327/581; 349/39; 315/169.3
See application file for complete search history.

(56) References Cited

U.S. PATENT DOCUMENTS

| | | | | |
|---|---|---|---|---|
| 5,969,701 | A | 10/1999 | Numao et al. | |
| 6,982,527 | B2 * | 1/2006 | Lee et al. | 315/224 |
| 7,126,565 | B2 * | 10/2006 | Kawasaki et al. | 345/76 |
| 2003/0117352 | A1 * | 6/2003 | Kimura | 345/87 |
| 2003/0197667 | A1 | 10/2003 | Numao | |
| 2004/0066358 | A1 * | 4/2004 | Numao | 345/76 |
| 2004/0070557 | A1 | 4/2004 | Asano et al. | |
| 2004/0145547 | A1 | 7/2004 | Oh | |
| 2005/0017934 | A1 | 1/2005 | Chung et al. | |

FOREIGN PATENT DOCUMENTS

| | | |
|---|---|---|
| JP | 09-127906 | 5/1997 |
| JP | 2002-514320 | 5/2002 |
| JP | 2003-529805 | 10/2003 |
| JP | 2004/133240 | 4/2004 |
| JP | 2004-226960 | 8/2004 |
| JP | 2004-341351 | 12/2004 |
| JP | 2005-31630 | 2/2005 |
| WO | WO 98/48403 A1 | 10/1998 |
| WO | WO 01/75852 A1 | 10/2001 |

* cited by examiner

*Primary Examiner*—Richard Hjerpe
*Assistant Examiner*—Mansour M Said
(74) *Attorney, Agent, or Firm*—Harness, Dickey & Pierce, P.L.C.

(57) ABSTRACT

A display device which makes it possible to shorten a selection period per pixel while compensating variations in a threshold voltage of the driving transistor, and a method for driving the same are achieved. In a pixel circuit Aij, a potential wire Ui is set to a potential Vcc, a voltage of a gate wire Gi becomes Low, a voltage of a control wire Ri becomes High, and a voltage of a control wire Pi becomes High, so that a gate terminal of a driving TFT: Q1 has a potential of a data wire Dj. Moreover, a voltage of the gate wire Gi becomes High so as to compensate a threshold voltage of the driving TFT: Q1. Thereafter, a voltage of the control wire Pi becomes Low, and the potential wire Ui is set to a potential Vc, so that a voltage of a capacitor C1, i.e., a gate-source voltage of the driving TFT is changed. This causes a voltage of the control wire Ri to be Low, so that a driving current is flown into an organic EL: EL1.

15 Claims, 26 Drawing Sheets

FIG. 3

| BIT NUMBERS | BIT WEIGHTS | BIT LENGTHS | OCCUPIED PERIOD NUMBERS | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|
| | | | 0 | 1 | 2 | 3 | 4 | 5 | 6 | 7 | | | | | | | | | | | | | | | | | | | | | | |
| 6 | 12 | 14 | ● | | | | | | | | | | | | | | | | | | | | | | | | | | | | | |
| 5 | 12 | 14 | | | | | | | ● | | | | | | | | | | | | | | | | | | | | | | | |
| 1 | 1 | 3 | | | | | ● | | | | | | | | | | | | | | | | | | | | | | | | | |
| 3 | 4 | 6 | | | | | | | | ● | | | | | | | | | | | | | | | | | | | | | | |
| 2 | 2 | 4 | | | | | | ● | | | | | | | | | | | | | | | | | | | | | | | | |
| 4 | 8 | 10 | | ● | | | | | | | | | | | | | | | | | | | | | | | | | | | | |
| 8 | 12 | 15 | | | | ● | | | | | | | | | | | | | | | | | | | | | | | | | | |
| 7 | 12 | 14 | | | ● | | | | | | | | | | | | | | | | | | | | | | | | | | | |
| | TOTAL | | ● | | | | | | | | | | | | | | | | | | | | | | | | | | | | | |
| | | | 6 | 4 | 7 | 8 | 1 | 2 | 5 | 3 | | | | | | | | | | | | | | | | | | | | | | |

| NUMBER OF LINES | NUMBER OF ITEMS OF DATA | TOTAL | DISPLAY PERIOD | B LENGTH |
|---|---|---|---|---|
| 10 | 8 | 80 | 63 | 17 |

FIG. 9

| | | | OCCUPIED PERIOD NUMBERS | | | | | | | |
|---|---|---|---|---|---|---|---|---|---|---|
| BIT NUMBERS | BIT WEIGHTS | BIT LENGTHS | 0 | 1 | 2 | 3 | 4 | 5 | 6 | 7 |
| 7 | 480 | 485 | ● | | | | | | | |
| 5 | 480 | 485 | | | | | | ● | | |
| 1 | 40 | 45 | | | ● | | | | | |
| 2 | 80 | 85 | | | | | | | | ● |
| 3 | 160 | 165 | | | | | ● | | | |
| 4 | 320 | 325 | | ● | | | | | | |
| 6 | 480 | 485 | | | | | | | ● | |
| 8 | 480 | 485 | | | | ● | | | | |
| | TOTAL | | ● | | | | | | | |
| | | | 7 | 4 | 1 | 8 | 3 | 5 | 6 | 2 |

| NUMBER OF LINES | NUMBER OF ITEMS OF DATA | TOTAL | DISPLAY PERIOD | B LENGTH |
|---|---|---|---|---|
| 320 | 8 | 2560 | 2520 | 40 |

FIG. 23

| BIT NUMBERS | BIT WEIGHTS | BIT LENGTHS | OCCUPIED PERIOD NUMBERS 0 | 1 | 2 | 3 | 4 | 5 | 6 | 7 |
|---|---|---|---|---|---|---|---|---|---|---|
| 7 | 18 | 18 | ● | | | | | | | |
| 6 | 17 | 17 | | | ● | | | | | |
| 1 | 1 | 1 | | | | ● | | | | |
| 2 | 2 | 2 | | | | | ● | | | |
| 4 | 7 | 7 | | | | | | | ● | |
| 3 | 4 | 4 | | | | | | ● | | |
| 5 | 14 | 14 | | ● | | | | | | |
| 8 | 0 | 9 | | | | | | | | ● |
| | TOTAL | 72 | ● | | | | | | | |

7 5 6 1 2 3 4 8

| NUMBER OF LINES | NUMBER OF ITEMS OF DATA | TOTAL | DISPLAY PERIOD | B LENGTH |
|---|---|---|---|---|
| 9 | 8 | 72 | 63 | 9 |

DISPLAY DEVICE AND METHOD FOR DRIVING THE SAME

This Nonprovisional application claims priority under 35 U.S.C. § 119(a) on Patent Application No. 2004/254615 filed in Japan on Sep. 1, 2004, the entire contents of which are hereby incorporated by reference.

FIELD OF THE INVENTION

The present invention relates to a display device using a current-driven electro-optic element such as an organic EL (electroluminescence) display or an FED (field emission display). The present invention also relates to a method for driving the display device.

BACKGROUND OF THE INVENTION

Recently, research and development of a current-driven light-emitting element such as an organic EL (electroluminescence) display or an FED have been actively carried out. Particularly, an organic EL display is a display which can emit light at low voltage and with low power consumption, and draws attention as being used for a mobile device such as a mobile phone or a PDA (personal digital assistance).

As an arrangement of a current-driven pixel circuit of such an organic EL display, a circuit arrangement disclosed in Japanese PCT Laid-Open Application No. 514320/2002 (Tokuhyo 2002-514320; published on Oct. 29, 1998: Corresponding to PCT International Publication No. WO/98/48403) is shown in FIG. 25.

A pixel circuit 300 shown in FIG. 25 includes four p-type TFTs (thin film transistors) 360, 365, 370, and 375 and two capacitors 350 and 355, and an organic EL (OLED) 380. The organic EL 380 is a current-driven electro-optic element and serves as a display light source. The TFTs 365 and 375 and the organic EL 380 are serially connected in this order to a path extending from a power supply line 390 to a common cathode (GND line). The capacitor 350 and the switching TFT 360 are serially connected in this order to a path extending from a gate terminal (current control terminal) of the driving TFT (driving transistor) 365 to a data line 310. Further, the switching TFT 370 is connected between the gate terminal of the driving TFT 365 and a drain terminal (current output terminal) of the driving TFT 365, and the capacitor 355 is connected between the gate terminal of the driving TFT 365 and a source terminal (reference potential terminal) of the driving TFT 365. A select line 320 is connected to a gate terminal of the TFT 360. An auto zero line 330 is connected to a gate terminal of the TFT 370. A lighting line 340 is connected to a gate terminal of the TFT 375.

In the pixel circuit 300, a voltage of the auto zero line 330 and a voltage of the lighting line 340 become Low in the first period, and the switching TFTs 370 and 375 are put in an ON state, so that the drain terminal of the driving TFT 365 and the gate terminal of the driving TFT 365 have the same potential. At this time, the driving TFT 365 is put in an ON state, so that a current flows from the driving TFT 365 to the OLED 380.

Further, at this time, a reference voltage is inputted into the data line 310, and a voltage of the select line 320 is made Low, so that an opposite terminal (TFT-360-side terminal) of the capacitor 350 has the reference voltage.

Next, in the second period, a voltage of the lighting line 340 becomes High, putting the TFT 375 in an OFF state.

In this way, a gate potential of the driving TFT 365 gradually increases, and when the gate potential of the driving TFT 365 reaches a value (+VDD−Vth) corresponding to a threshold voltage (−Vth) of the driving TFT 365, the driving TFT 365 is put in an OFF state.

Then, in the third period, a voltage of the auto zero line 330 becomes High, putting the switching TFT 370 in an OFF state. In this way, a difference between a gate potential of the capacitor 350 and a reference potential of the capacitor 350 is stored in the capacitor 350.

That is, when a potential of the data line 310 is the reference potential, the gate potential of the driving TFT 365 is the value (+VDD−Vth) corresponding to the threshold voltage (−Vth) of the driving TFT 365. Moreover, when the potential of the data line 310 changes from the reference potential, a current corresponding to the potential change flows into the driving TFT 365 regardless of the threshold voltage of driving TFT 365.

Accordingly, such a desired potential change is supplied to the data line 310, so that a voltage of the select line 320 becomes High, and the switching TFT 360 is put in an OFF state. In this way, a potential of the gate terminal of the driving TFT 365 is maintained, and a pixel selection period is terminated.

Thus, the use of the pixel circuit shown in FIG. 25 makes it possible to compensate fluctuation in the threshold voltage of the driving TFT 365, thereby supplying a potential of the compensated threshold voltage (desired potential—threshold voltage) to the gate terminal of the driving TFT 365.

Further, as another arrangement of a current-driven pixel circuit of an organic EL display, a circuit arrangement disclosed in Japanese PCT Laid-Open Application No. 529805/2003 (Tokuhyo 2003-529805; published on Oct. 11, 2001: Corresponding to PCT International Publication No. WO01/075852) is shown in FIG. 26.

A pixel circuit Aij shown in FIG. 26 includes three p-type TFTs 30, 32, and 37 and an n-type TFT 33, a capacitor 38, and an organic EL (OLED) 20. The organic EL 20 is a current-driven electro-optic element and serves as a display light source. The TFTs 30 and 33 and the organic EL 20 are serially connected in this order to a path extending from a power supply line 31 to a common cathode (GND line) 34. The switching TFT 32 is disposed between a gate terminal (current control terminal) of the driving TFT 30 and a drain terminal (current output terminal) of the driving TFT 30, and the capacitor 38 is disposed between the gate terminal of the driving TFT 30 and a source terminal (reference potential terminal) of the driving TFT 30. The switching TFT 37 is connected between the drain terminal of the driving TFT 30 and a source wire Sj. A gate wire Gi is connected to a gate terminal of each of the TFTs 32, 37, and 33.

With this arrangement, in a time period (selection period) during which a voltage of the gate wire Gi is Low, the switching TFT 33 is put in an OFF state, and the switching TFTs 32 and 37 are put in an ON state. As a result, a current flows from the power supply line 31 through the driving TFT 30 and the switching TFT 37 to the source wire Sj. When a current value at this time is controlled by a current source of a source driver circuit (not shown) connected to the source wire Sj, a gate voltage of the driving TFT 30 can be set so that an output current value of the driving TFT 30 becomes equal to the current value regulated by the source driver circuit.

Thereafter, a voltage of the gate wire Gi becomes High, so that the TFTs 32 and 37 are put in an OFF state, and the gate voltage of the driving TFT 30 is retained. Further, the TFT 33 is put in an ON state, so that the current value set in the selection period is outputted from the driving TFT 30 to the organic EL (OLED) 20.

Thus, the use of the pixel circuit shown in FIG. 26, regardless of fluctuation in threshold voltage of the driving TFT 30 or fluctuation in mobility of the driving TFT 30, makes it possible to set a gate potential of the driving TFT 30 so that the output current value of the driving TFT 30 becomes equal to the current value supplied from the current source of the source driver circuit.

As described above, the use of the pixel circuit shown in FIG. 25 makes it possible to compensate the fluctuation of the threshold voltage of the driving TFT 365. However, with the pixel circuit arrangement of FIG. 25, it takes several tens of microseconds (Vs) for the driving TFT 365 to shift from an ON state to an OFF state, and the reference potential must be retained in the data line 310 during this period. This increases the duration of selection period per pixel, and thus results in display of less number of pixels.

Further, with the pixel circuit arrangement of FIG. 26, it is possible to compensate the fluctuation in the threshold voltage of the driving TFT 30 and the fluctuation in mobility of the driving TFT 30. However, the foregoing problem occurs more conspicuously.

More specifically, also in the pixel circuit of FIG. 26, the source wire Sj has a floating capacitance. Therefore, the pixel circuit of FIG. 26 is controlled so that a desired current flows from the driving TFT 30 to the source driver circuit. Therefore, when a value of the desired current is small, it takes several hundred microseconds (μs) or more only to charge the floating capacitance.

As a result, a selection period per pixel is lengthened. This raises a problem that the number of pixels which can be displayed decreases accordingly.

SUMMARY OF THE INVENTION

The present invention is designed to solve the foregoing problems and has as an object to realize a display device which makes it possible to shorten a selection period per pixel while compensating variations in a threshold voltage of a driving transistor, and a method for driving the same.

In order to solve the foregoing problems, a display device of the present invention includes: an electro-optic element, being a current-driven type, which serves as a display light source; a driving transistor for supplying an output current from a current output terminal to the electro-optic element as a driving current for driving the electro-optic element, the output current being controlled by a voltage which is applied between a current control terminal and a reference potential terminal; a first switching transistor; a second switching transistor; and a first capacitor, the electro-optic element and the driving transistor being disposed in each of a plurality of pixels which are aligned in a matrix manner, and the driving current corresponding to display data supplied from a data wire to the pixel, wherein: the driving transistor, the first switching transistor, and the electro-optic element are serially connected, and the current control terminal of the driving transistor is connected to a first terminal of the first capacitor, and the second switching transistor is provided between the current control terminal and the current output terminal of the driving transistor, and the second switching transistor is put in an ON state and the first switching transistor is put in an OFF state in a first period which starts from a time when a potential corresponding to display data of the pixel is supplied from the data wire to the current control terminal of the driving transistor and a corresponding charge is stored in the first capacitor, and the output current of the driving transistor is adjusted in a second period by changing a potential of a second terminal of the first capacitor or a potential of the reference potential terminal of the driving transistor.

According to the foregoing invention, a potential corresponding to display data of the pixel is supplied to the current control terminal of the driving transistor before or at the same time as the first period. Moreover, by compensating a threshold voltage of the driving transistor which has been put in an ON state in the first period, the potential of the current control terminal of the driving transistor becomes larger than a potential Vs of the reference potential terminal of the driving transistor by a threshold voltage Vth. Further, although a threshold voltage of the driving transistor which has been put in an OFF state cannot be compensated, there is no problem, because an OFF state is not dependent on a threshold voltage. Moreover, by changing, in the second period, the potential of the current control terminal of the driving transistor or the potential of the reference potential terminal of the driving transistor, an output current of the driving transistor can be set a desired current value regardless of a threshold voltage.

In order to solve the foregoing problems, a display device of the present invention includes: an electro-optic element, being a current-driven type, which serves as a display light source; a driving transistor for supplying an output current from a current output terminal to the electro-optic element as a driving current for driving the electro-optic element, the output current being controlled by a voltage which is applied between a current control terminal and a reference potential terminal; a first switching transistor; a second switching transistor; and a first capacitor, the electro-optic element and the driving transistor being disposed in each of a plurality of pixels which are aligned in a matrix manner, and the driving current corresponding to display data supplied from a data wire to the pixel, wherein: the driving transistor, the first switching transistor, and the electro-optic element are serially connected, and the current control terminal of the driving transistor is connected to a first terminal of the first capacitor, and the second switching transistor is provided between the current control terminal and the current output terminal of the driving transistor, and the second switching transistor is put in an ON state and the first switching transistor is put in an ON state before a first period, and the second switching transistor is put in an ON state and the first switching transistor is put in an OFF state in the first period, and the output current of the driving transistor is adjusted in a second period by changing a potential of a second terminal of the first capacitor or a potential of the reference potential terminal of the driving transistor.

According to the foregoing invention, before the first period, the second switching transistor is put in an ON state and the first switching transistor is also put in an ON state, so that the driving transistor can be put in an ON state. Moreover, by compensating a threshold voltage of the driving transistor which has been put in an ON state in the first period, the potential of the current control terminal of the driving transistor becomes larger than a potential Vs of the reference potential terminal of the driving transistor by a threshold voltage Vth. Moreover, a potential corresponding to display data of the pixel is supplied from the data wire to the current control terminal of the driving transistor, so that a potential of the other terminal of the first capacitor or a potential of the reference potential terminal of the driving transistor is changed. In this way, an output current of the driving transistor can be set at a desired current value regardless of a threshold voltage.

The data wire only needs to be connected to the pixel at least from the time that a potential corresponding to display data of the pixel is supplied to the current control terminal of the driving transistor until a corresponding charge is stored the first capacitor. Therefore, the pixel does not need to occupy the data wire in a period during which a threshold voltage of the driving transistor is compensated. This brings about an effect of achieving a display device which makes it possible to shorten a selection period per pixel while compensating variations in the threshold voltage of the driving transistor.

For a fuller understanding of the nature and advantages of the invention, reference should be made to the ensuing detailed description taken in conjunction with the accompanying drawings.

BRIEF DESCRIPTION OF THE DRAWINGS

FIG. 3 is a diagram showing a first time sequence pattern of a display device according to First to Fifth Embodiments of the present invention.

FIG. 9 is a diagram showing a second time sequence pattern of the display device according to the First to Fifth Embodiments of the present invention.

FIG. 23 is a diagram showing a time sequence pattern of the display device according to the Sixth Embodiment of the present invention.

DESCRIPTION OF THE EMBODIMENTS

The embodiments of the present invention will be described below with reference to FIGS. 1 to 24.

A switching element used for the present invention can be made of a low-temperature polysilicon TFT or a CG (continuous grain) silicon TFT. In the present embodiments, a CG silicon TFT is used.

Here, an arrangement of a CG silicon TFT is disclosed for example in Non-Patent Document 1 ("4.0-in. TFT-OLED Displays and a Novel Digital Driving Method" (*SID '00 Digest*, pp. 924-927, Semiconductor Energy Laboratory Co., Ltd.)), and a process for producing a CG silicon TFT is disclosed for example in Non-Patent Document 2 ("Continuous Grain Silicon Technology and Its Applications for Active Matrix Display" (*AM-LCD* 2000, pp. 25-28, Semiconductor Energy Laboratory Co., Ltd.)). As disclosed therein, the arrangement of the CG silicon TFT and the process for producing the same are both publicly known, thus a detailed description thereof is omitted here.

Further, since an arrangement of an organic EL element serving as an electro-optic element used in the present embodiments is also publicly known, as can be found in for example Non-Patent Document 3 ("Polymer Light-Emitting Diodes for Use in Flat Panel Display" (*AM-LCD '01*, pp. 211-214, Semiconductor Energy Laboratory Co., Ltd.)), a detailed description thereof is omitted here.

First Embodiment

In the present embodiment, a first example of a display device of the present invention will be described.

Figure 2:
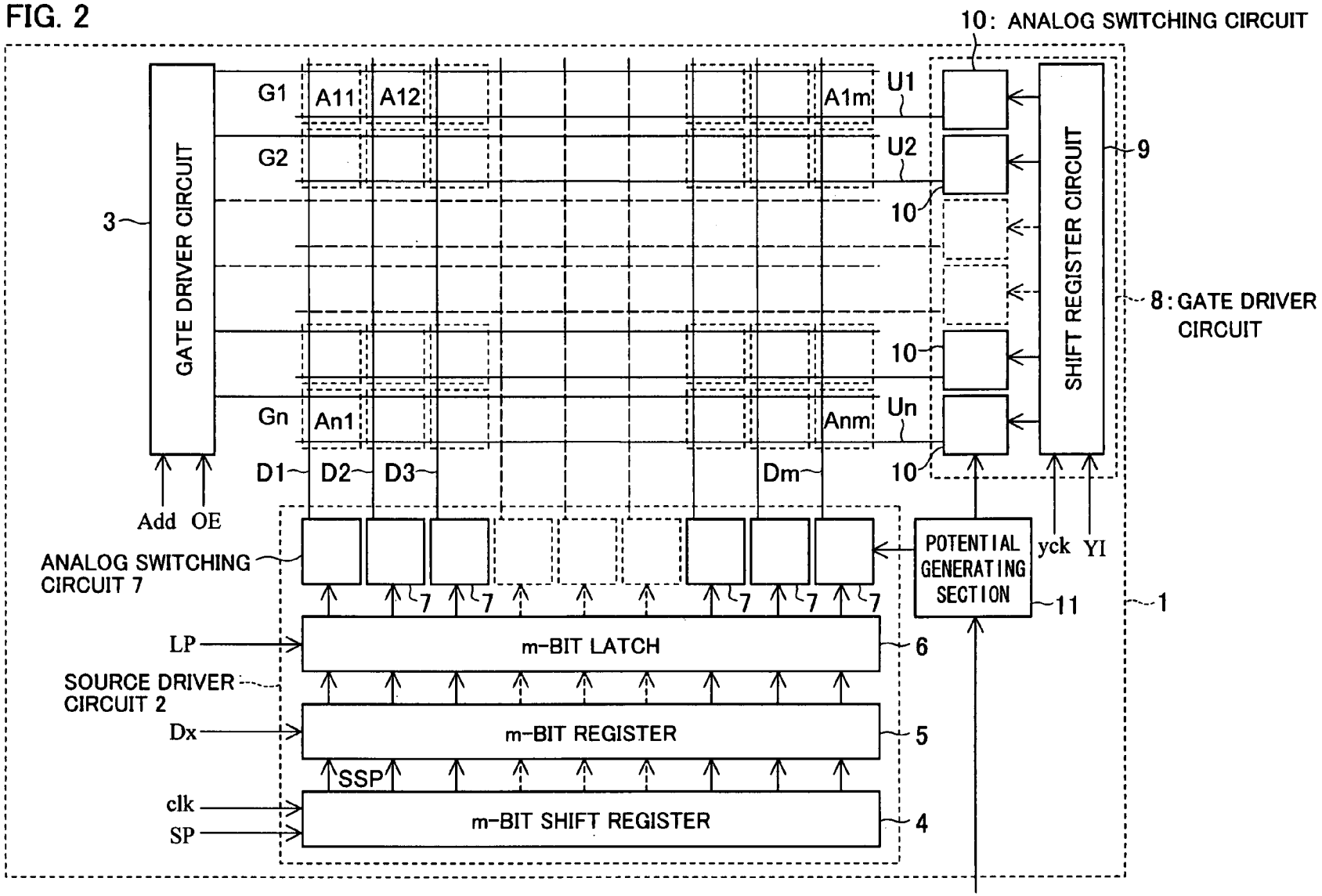
FIG. 2 is a circuit block diagram showing an arrangement of a display device of the present invention.

A display device 1 of the present embodiment, as shown in FIG. 2, has pixel circuits Aij (i=1 to n, j=1 to m), gate drivers 3 and 8, a source driver 2, and a potential generating section 11. The pixel circuits Aij are disposed in a matrix manner. The gate drivers 3 and 8 and a source driver circuit 2 serve as a wiring control circuit for the pixel circuits Aij. The potential generating section 11 serves as an internal voltage generating circuit.

Each of the pixel circuits Aij is disposed in a region where a data wire Dj and a gate wire Gi intersect with each other. Further, the source driver circuit 2 includes an m-bit shift register 4, an m-bit register 5, an m-bit latch 6, and m-number of analog switch circuits 7.

In the source driver circuit 2, a first register of the m-bit shift register 4 receives a start pulse SP, and the start pulse SP is transferred in accordance with a clock clk in the shift register 4 while also being outputted as a timing pulse SSP to the register 5. The m-bit register 5 uses the timing pulse SSP, which is sent from the shift register 4, to hold input one-bit data Dx at a position of the corresponding data wire Dj. The latch 6 fetches the held m-bit data at the timing of a latch pulse LP and outputs the data to each of the analog switch circuits 7. The analog switch circuit 7 selects, from the potential generating section 11, a potential VH or VL corresponding to the input data, and outputs the potential VH or VL to the data wire Dj.

Further, the gate driver circuit 3 includes a decoder circuit (not shown) and a buffer circuit (not shown). The decoder circuit decodes an input address Add. The address Add passes through the buffer circuit at a timing in accordance with a control signal OE and is outputted to the corresponding gate wiring Gi.

The gate driver circuit 8 includes a shift register circuit 9 and analog switch circuits 10. The first register of the shift register circuit 9 receives, for example, an input control signal Yi, and the control signal Yi is transferred in accordance with a clock yck in the shift register circuit 9 and is outputted to each of the analog switch circuits 10 and a buffer circuit (not shown). The analog switch circuit 10 selects a voltage Vcc or a voltage Vc from the potential generating section 11 according to the input data, and outputs the voltage Vcc or the voltage Vc to a potential wire Ui. The buffer circuit amplifies the input data and outputs the input data to corresponding control wires Pi and Ri.

Figure 1:
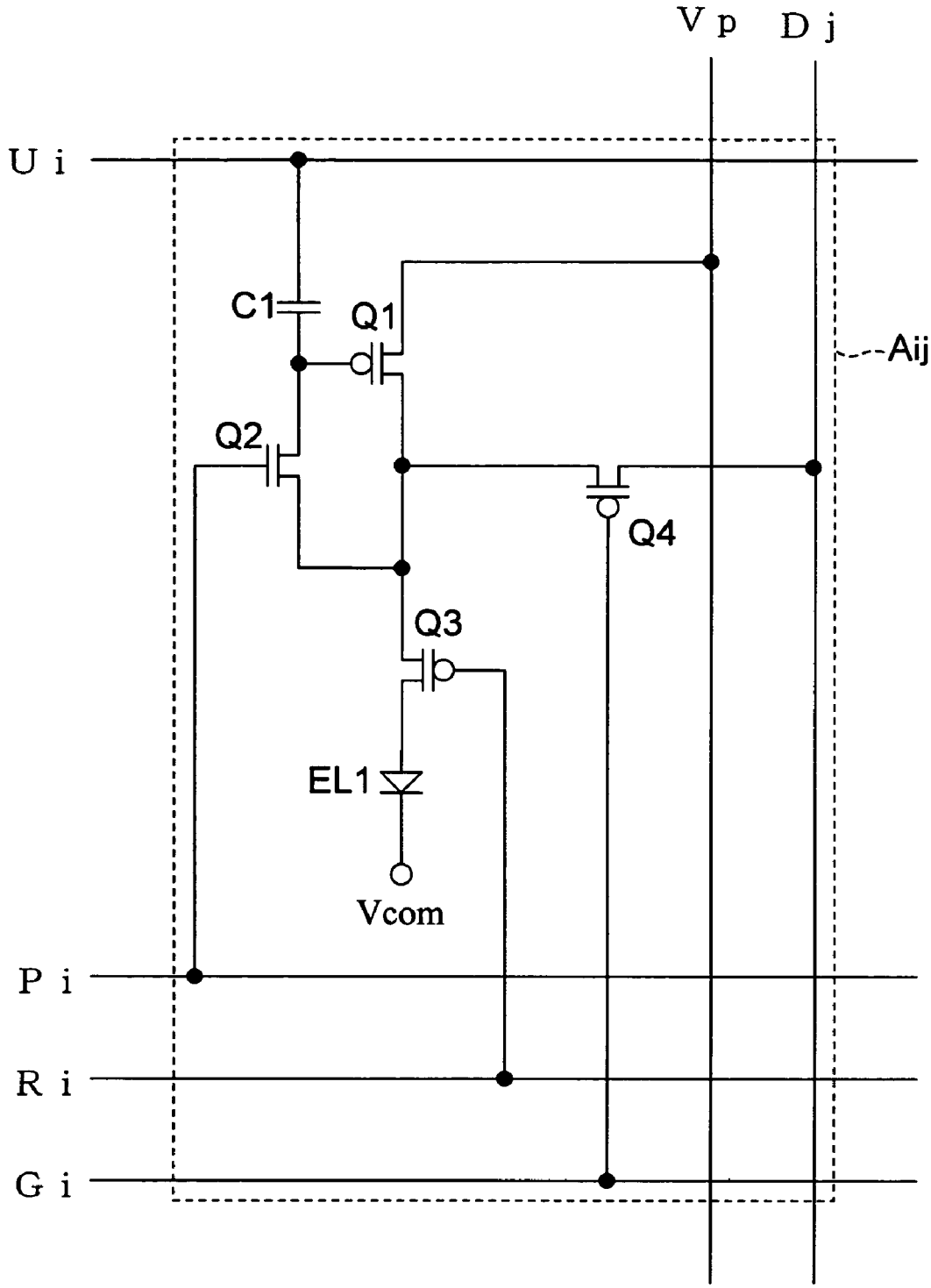
FIG. 1 is a circuit diagram showing a pixel circuit arrangement (layout) in a display device according to a First Embodiment of the present invention.

FIG. 1 shows an arrangement of the pixel circuit Aij.

In the pixel circuit Aij, a driving TFT: Q1 (driving transistor) and an organic EL: EL1 (electro-optic element) are disposed near an intersection of a data wire Dj (second wire) and a gate wire Gi. Moreover, the driving TFT: Q1, a switching TFT: Q3 (first switching transistor), and the organic EL: EL1 are serially connected in this order to a path extending from a power supply wire Vp to a common wire Vcom. The organic EL: EL1 is an electro-optic element and serves as a display light source.

One terminal of a capacitor C1 (first capacitor) is connected to a gate terminal (current control terminal) of the driving TFT: Q1, and a switching TFT: Q2 (second switching transistor) is provided between the gate terminal of the driving TFT: Q1 and a drain terminal (current output terminal) of the driving TFT: Q1. The driving TFT: Q1 is a driving transistor whose output current is controlled by a voltage applied between a gate terminal and a source terminal. Note that although a drain terminal of an n-type driving TFT is a terminal where the input current enters, the drain terminal is termed a current output terminal since the n-type driving TFT also determines a driving current of an organic EL element.

Further, a potential wire Ui (first wire) is connected to the other terminal of the capacitor C1, and a switching TFT: Q4 (third switching transistor) is provided between the drain terminal (current output terminal) of the driving TFT: Q1 and the data wire Dj.

The control wire Pi is connected to a gate terminal of the switching TFT: Q2. The control wire Ri is connected to a gate terminal of the switching TFT: Q3. The gate wire Gi is connected to a gate terminal of the switching TFT: Q4.

Note that the driving TFT: Q1 and the switching TFTs Q3 and Q4 are p-type TFTs, and the switching TFT: Q2 is an n-type TFT.

In this pixel circuit arrangement, the driving TFT: Q1 can be put in either an ON state or an OFF state. Accordingly, time-sharing gradation display is used in the present embodiment.

An example of a time-sharing gradation display method is disclosed in Patent Document 3 (Japanese Laid-Open Patent Application No. 127906/1997 (Tokukaihei 9-127906; published on May 16, 1997: Corresponding to U.S. patent Publication No. 5969701)). However, the time sequence pattern shown in FIG. 3 is used here.

The time sequence pattern of FIG. 3 shows how binary (0 and 1) data is supplied in chronological order to each of the pixel circuits Aij during one frame period. The pixel circuit Aij receives, from the source driver circuit 2, 8-bit data bit by bit through one frame period in chronological order. As can be seen from the columns indicated by "bit numbers" and "bit weights", bits 1 to 8 weigh in a ratio of 1:2:4:8:12:12:12:12. Each of the weights represents the length of an ON/OFF period, and visible brightness of pixel through one frame period is varied depending on the total length of an ON period under constant luminescence. The use of the bit weights allows 64-gradation display of 0 to 63 in total. That is, the weights 1, 2, 4, and 8 can be used to express 0 to 15 when none of the four weights 12 is used. The weights 1, 2, 4, 8, and 12 can be used to express 12 to 27 when one of the four weights 12 is used. The weights 1, 2, 4, 8, 12, and 12 can be used to express 24 to 39 when two of the four weights 12 are used. The weights 1, 2, 4, 8, 12, 12, and 12 can be used to express 36 to 51 when three of the four weights 12 are used. The weights 1, 2, 4, 8, 12, 12, 12, and 12 can be used to express 48 to 63 when all of the four weights 12 are used.

The 64-gradation display is performed in each pixel in a display order of 12:12:1:4:2:8:12:12 so as to avoid repetition of "occupied period number". Accordingly, the "bit numbers" are rearranged in an order of 6→5→1→3→2→4→8→7 and supplied to the pixel circuit Aij. This is because, as in the column indicated by "bit lengths" (each of the "bit lengths" is obtained by adding a nondisplay period (blanking period) to each of the "bit weights" corresponding to "occupied period number"), the "bit lengths" are arranged in an order of 14:14:3:6:4:10:15:14 so that a surplus of 0 of 0/8, a surplus of 6 of 14/8, a surplus of 4 of (14+14)/8, a surplus of 7 of (14+14+3)/8, . . . do not overlap with one another. Therefore, the total of the bit lengths during one frame period is 14+14+3+6+4+10+15+14=80. When 1 bit length is regarded 1 bit period, one frame period is an 80-bit period. Further, the one-bit period is a period during which a potential corresponding to the data wire Dj is outputted in order to set one-bit data in the pixel circuit Aij.

Figure 4:
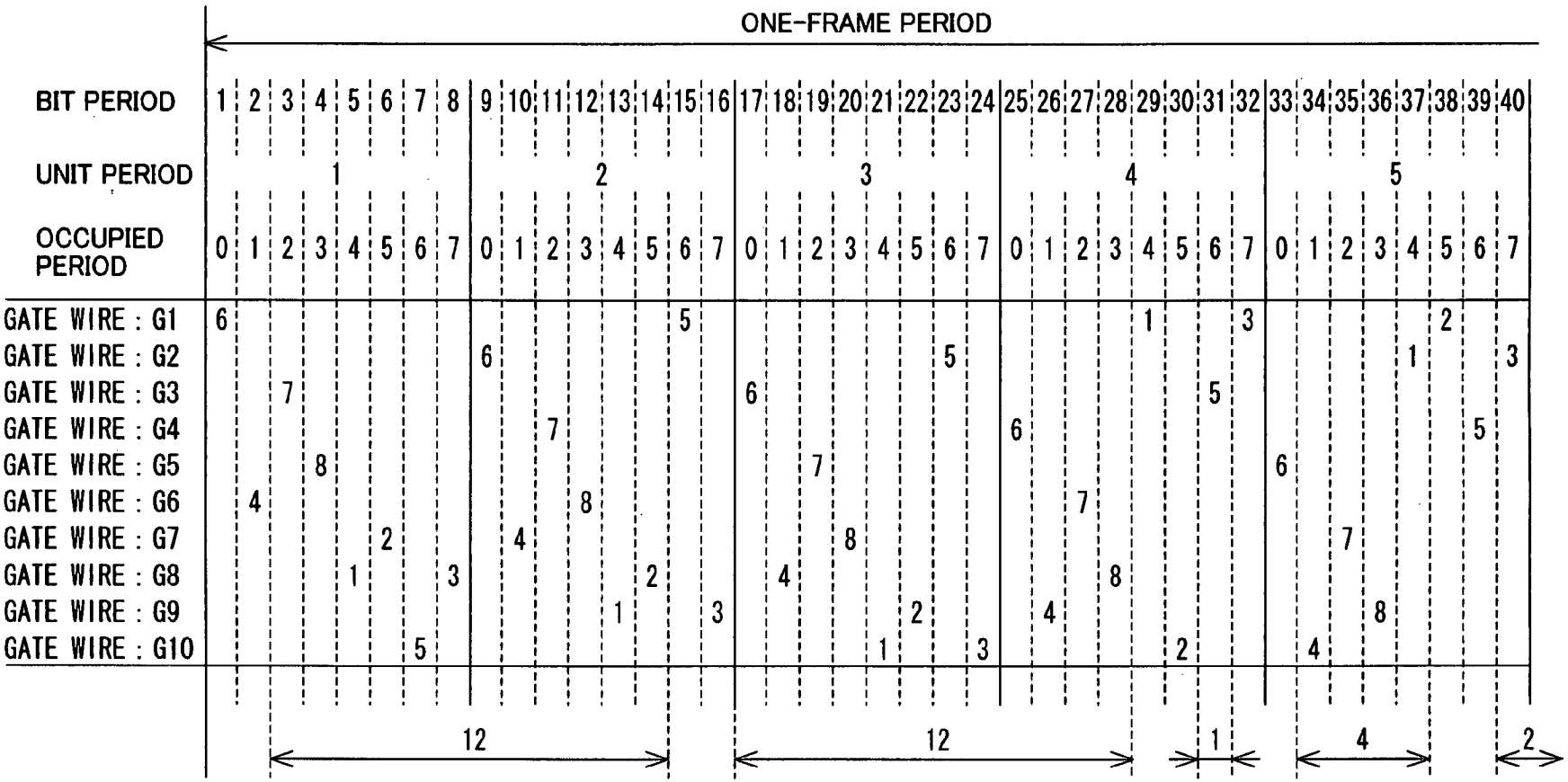
FIG. 4 is a first half of timing chart showing a data signal in one frame period in the time sequence pattern of FIG. 3.
Figure 5:
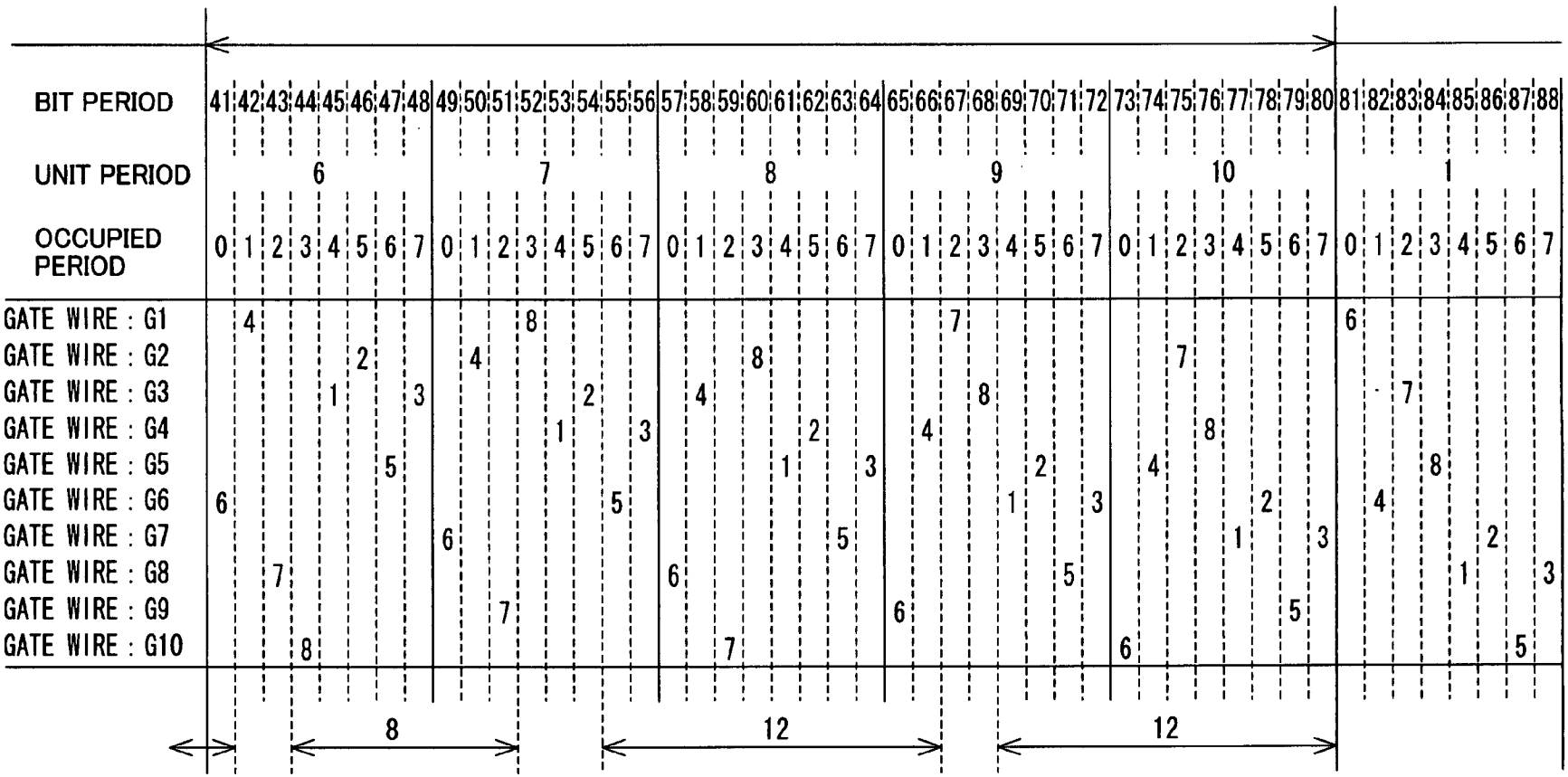
FIG. 5 is a second half of the timing chart showing the data signal in one frame period in the time sequence pattern of FIG. 3.

Provided that there are ten lines (gate wires Gi), FIGS. 4 and 5 show the individual bit periods of a data wire Dj, each of which has a number denoting a specific bit data for a pixel connected to one of the gate wires Gi. FIG. 4 shows data supply in a first half of one frame period, and FIG. 5 shows data supply in a second half of one frame period.

In FIGS. 4 and 5, the row indicated by "gate wire G1" shows how bit data is supplied through a time sequence to that pixel A1j of a data wire Dj which is connected to a gate wire G1. In the first bit period, bit-6 data is supplied to the pixel A1j. In the fifteenth bit period after fourteen bit periods, bit-5 data is supplied to the pixel A1j. In the 29th bit period after fourteen bit periods more, bit-1 data is supplied to the pixel A1j. In the 32nd bit period after three bit periods more, bit-3 data is supplied to the pixel A1j. In the 38th bit period after six bit periods more, bit-2 data is supplied to the pixel A1j. In the 42nd bit period after four bit periods more, bit-4 data is supplied to the pixel A1j. In the 52nd bit period after ten bit periods more, bit-8 data is supplied to the pixel A1j. In the 67th bit period after fifteen bit periods more, bit-7 data is supplied to the pixel A1j. Finally, in the 81st bit period after further fourteen bit periods, the sequence is back to the first period, and bit-6 data is again supplied to the data wire Dj.

Note that, with respect to the pixel A1j selected by the gate wire G1, a period corresponding to a bit weight obtained by subtracting a blanking period from a bit length, i.e., a period during which the pixel A1j is ON is shown in a lowermost part of FIGS. 4 and 5. Thus, the first two bit periods of the bit length of each of the bit numbers 6, 5, 1, 3, 2, 4, and 7 and the first three bit periods of the bit length of the bit number 8 serve as blanking periods. The same applies to the other gate wires.

Among pixels connected to the data wire Dj, a pixel connected to a next gate wire Gi+1 is supplied with bit data corresponding to each of the gate wires G1, through the data wire Dj, with a delay of eight bit periods. For example, in the row indicated by "gate wire G2", the same bit data as that supplied to the gate wire G1 is supplied to the data wire Dj with a delay of eight bit periods. When the bit data is supplied to each data wire G1 in such a manner, data supply to a certain data wire Dj is carried out as follows. That is, in the first bit period, the bit-6 data is supplied to the pixel A1j connected to the gate wire G1; in the second bit period, the bit-4 data is supplied to a pixel A6j connected to the gate wire G2; in the third bit period, the bit-7 data is supplied to a pixel A3j connected to a gate wire G3.

Thus, the respective bit data items for the gate wires Gi are supplied to the same data wire Dj at different timings. Further, the bit data supplied to each bit period of a certain data wire Dj corresponds to one of the gate wires Gi.

In view of this, the eighty bit periods in FIGS. 4 and 5 making one frame period are divided by eight bit periods, broken into ten groups. The groups are named unit periods 1 to 10, and the eight bit periods in each of the unit periods are named occupied periods 0 to 7. In this way, bit 6, 5, 1, 3, 2, 4, 8, and 7 securely appear in this order in the occupied periods 0, 6, 4, 7, 5, 1, 3, and 2.

This correspondence is shown by marking corresponding intersections of the vertical axis denoting the bits and the horizontal axis denoting the occupied periods with symbols '●(filled circles)', thereby yielding "bit lengths" versus "occupied period numbers" of FIG. 3.

Note in the time sequence pattern that each of the bit lengths is larger than each of the bit weights. The period difference, as shown in the timing chart of Fig., is compensated by a blanking period, which forces the driving TFT: Q1 to be in an OFF state by causing the potential wire Ui to have Vcc or the like. The blanking period is provided in the beginning of the whole occupied period of each bit.

In the following, operation of the pixel circuit Aij of FIG. 1, as well as the blanking period, is described with reference to the timing chart shown in FIG. 6.

Figure 6:
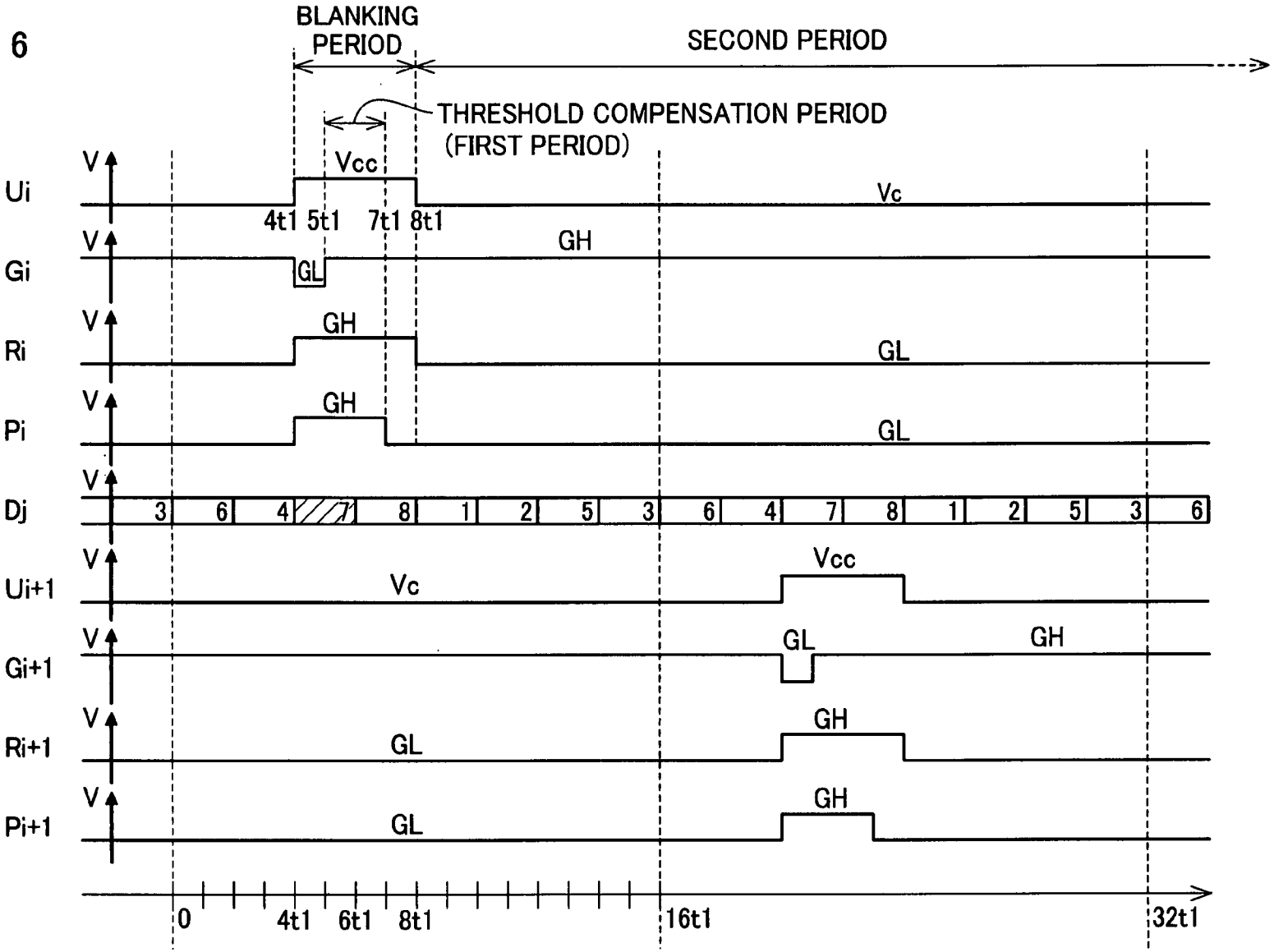
FIG. 6 is a first waveform diagram showing operating timing of a pixel circuit of FIG. 4.

In FIG. 6, Ui, G1, Ri, and Pi correspond to the pixel circuit Aij, and Ui+1, Gi+1, Ri+1, and Pi+1 correspond to a pixel circuit Ai+1j. Dj represents bit-1-to-8 data supplied to the data wire Dj. Further, a period of t1 is a half bit period.

A period between times 4t1 and 6t1 (i.e., a 4t1-6t1 period; hereinafter, similar expressions are termed in the same way) is a bit period during which the bit-7 data is set in the pixel circuit Aij, and a 4t1-8t1 period is a blanking period.

At the time 4t1, the potential wire Ui has a potential Vcc, and the blanking period starts. Moreover, a voltage of the control wire Ri becomes High (GH), putting the switching TFT: Q3 in an OFF state. Further, a voltage of the control wire Pi becomes High (GH), putting the switching TFT: Q2 in an ON state. Further, a voltage of the gate wiring Gi becomes Low (GL), putting the switching TFT: Q4 in an ON state.

At this time, when a potential supplied to the data wire Dj is VL, a gate potential of the driving TFT: Q1 becomes low, putting the driving TFT: Q1 put in an ON state. When the potential is VH, a gate potential of the driving TFT: Q1 becomes high, putting the driving TFT: Q1 in an OFF state.

That is, provided that a potential of the power supply wire Vp is Vp, and the (maximum) absolute value of a maximum value of variations in a threshold voltage of the driving TFT: Q1 is Vth (max), and the (minimum) absolute value of a minimum value of the variations in the threshold voltage of the driving TFT: Q1 is Vth (min), the following relations are satisfied.

$$VL<Vp-Vth(\max)$$

$$VH>Vp-Vth(\min)$$

According to this, for example, the potential VL is supplied to the data wire Dj, and since the switching TFTs Q2 and Q4 are in an ON state, a gate potential of the driving TFT: Q1 is also VL. For this reason, the driving TFT: Q1 is in an ON state wherever its threshold voltage Vth is in the variations. Conversely, when the potential VH is supplied to the data wire Dj, a gate potential of the driving TFT: Q1 is also VH. For this reason, the driving TFT: Q1 is in an OFF state wherever its threshold voltage Vth is in the variations.

Thereafter, at the time 5t1, a voltage of the gate wire Gi becomes High (GH), putting the switching TFT: Q4 in an OFF state.

A 5t1-7t1 period serves as a threshold compensation period (first period) of the driving TFT: Q1. When the driving TFT: Q1 is in an ON state at the time 5t1, i.e., when the data wire Dj has the potential VL, a current flows from the power supply wire Vp through a drain of the driving TFT: Q1 to a gate of the driving TFT: Q1 and one terminal of the capacitor C1 during the threshold compensation period, so that a gate potential of the driving TFT: Q1 rises up to Vp−Vth so as for the driving TFT: Q1 to be in an OFF state (hereinafter referred to as a state VL). In contrast, when the driving TFT: Q1 is in an OFF state at the time 5t1, i.e., when the date wire Dj has the potential VH, a gate potential of the driving TFT: Q1 remains VH (hereinafter referred to as a state VH) during the threshold compensation period.

Thereafter, at the time 7t1, a voltage of the control wire Pi becomes Low (GL), putting the switching TFT: Q2 in an OFF state, and the threshold compensation period of the driving TFT: Q1 is terminated. In this way, a charge of the capacitor C1 and therefore a gate-source voltage of the driving TFT: Q1 are retained. Therefore, when having the state VL during the threshold compensation period, a gate potential of the driving TFT: Q1 is retained in the potential Vp−Vth, and when having the state VH during the threshold compensation period, Q1 is retained in the potential VH. In the present embodiment, the threshold compensation period, i.e., the first period starts from the time when a potential corresponding to display data of each pixel is supplied from the data wire Dj to the gate terminal of the driving TFT: Q1 at the time 4t1 and a corresponding charge is stored in the capacitor C1.

Moreover, at the time 8t1, a voltage of the control wire Ri becomes Low (GL), putting the switching TFT: Q3 in an ON state, and a potential of the potential wire Ui is changed to Vc (Vc<Vcc), and the blanking period is terminated. This is the start of second period.

At this time, if the state is VH during the threshold compensation period, since a potential of the potential wire Ui decreases by Vcc−Vc, a gate potential of the driving TFT: Q1 whose potential is VH, i.e., a potential of the one terminal of the capacitor C1 is changed to VH−(Vcc−Vc). Therefore, the driving TFT: Q1 in the state VH remains in an OFF state if the following condition is satisfied.

$$VH-(Vcc-Vc)>Vp-Vth(\min)$$

In contrast, if the state is VL during the threshold compensation period, a gate potential of the driving TFT: Q1 can be found by the following way.

$$Vp-Vth-(Vcc-Vc)$$

This is a potential lower than a threshold state of the driving TFT: Q1 by a constant voltage of Vcc−Vc. Therefore, a constant current flows through the driving TFT: Q1 regardless of the threshold voltage Vth of the driving TFT: Q1.

Figure 7:
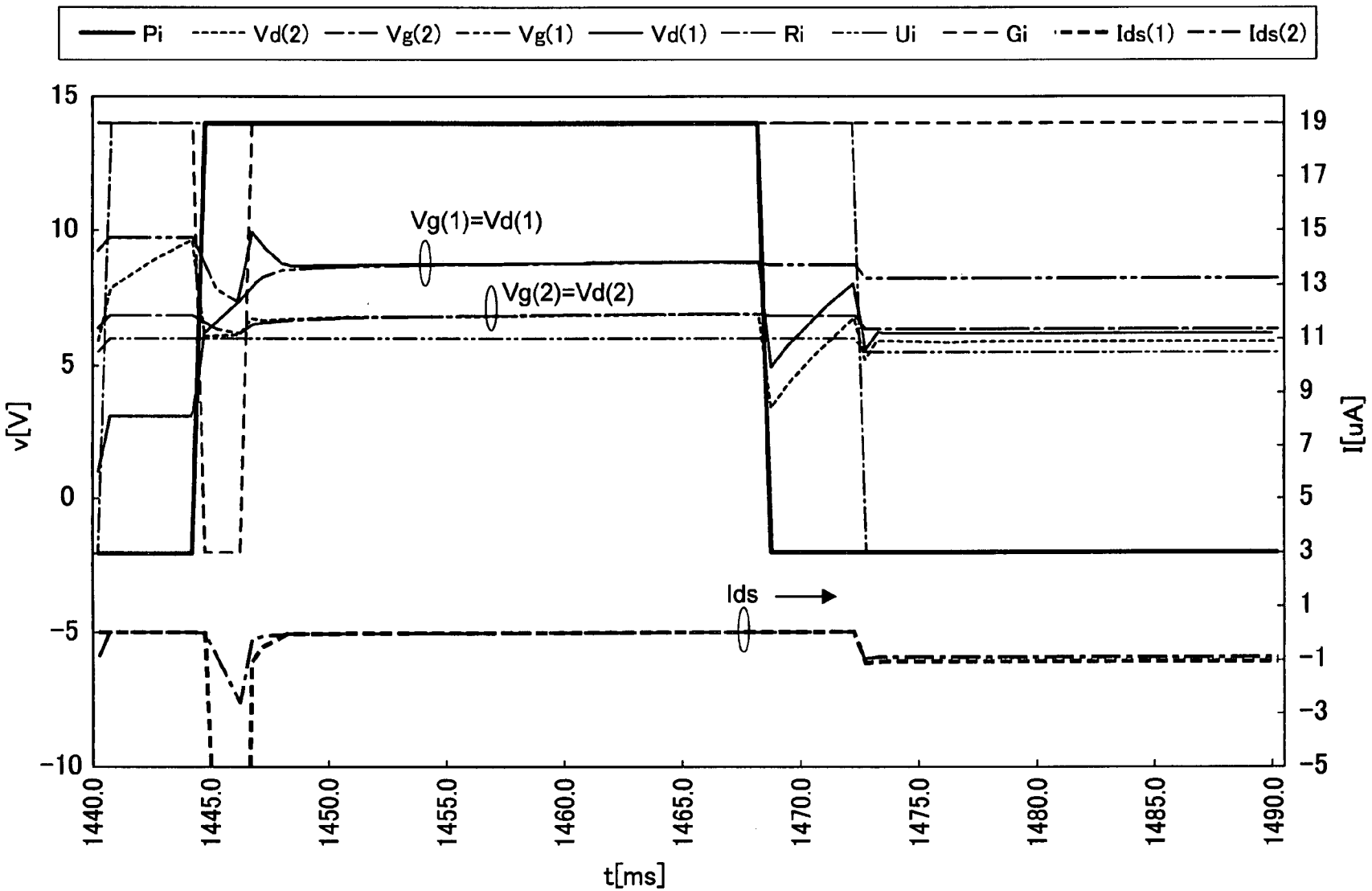
FIG. 7 is a first graph showing a result of simulating fluctuations in a gate potential Vg, a drain potential Vd, and a source-drain current Ids of a driving TFT in the pixel circuit of FIG. 4.

Accordingly, FIG. 7 shows a result of simulating a gate potential Vg, a drain potential Vd, and a source-drain current Ids of the driving TFT: Q1 when having the state VL during the threshold compensation period. In the figure, (1) denotes the voltage and current in the case where a threshold value is at its minimum (Vth (min)) and a mobility degree p is at its maximum, while (2) denotes those in the case where the threshold value is at its maximum (Vth (max)) and the mobility degree p is at its minimum. Further, the timings of rise and fall of voltage in FIG. 7 differs from FIG. 6. That is, after a voltage of the control wire Ri becomes High (GH), a voltage of the control wire Pi becomes High (GH) and a voltage of the gate wire Gi becomes Low (GL). This applies when the switching TFT: Q3 is put in an OFF state first, and there is not a substantial difference between FIG. 7 and FIG. 6.

As can be seen from the simulation result in FIG. 7, after a voltage of the control wire Ri becomes Low (GL), causing the potential wire Ui to have the potential Vc, the source-drain current Ids of the driving TFT: Q1 becomes substantially constant (leaving an influence of the mobility degree) regardless of the threshold value of the driving TFT: Q1.

Note that a current flowing through the driving TFT: Q1 at this time is proportional to the square of a difference between the potential Vcc and the potential Vc.

In view of this, the potential Vcc is obtained from the power supply Vp so that the more pixels are turned on in the display device as the potential Vcc becomes lower. Moreover, a resistor or the like is disposed between a power supply outside the display device and the power supply wire Vp so that the more pixels are turned on in the display device, the lower the potential Vcc becomes. Meanwhile, the potential Vc is required to always have the same value, and therefore it is derived from a logic power supply by a resistive potential dividing process or the like.

With such an arrangement, the pixel circuit etc. of the present embodiment obtains peak luminance in which the luminance of white increases as the number of display pixels decreases.

Figure 8:
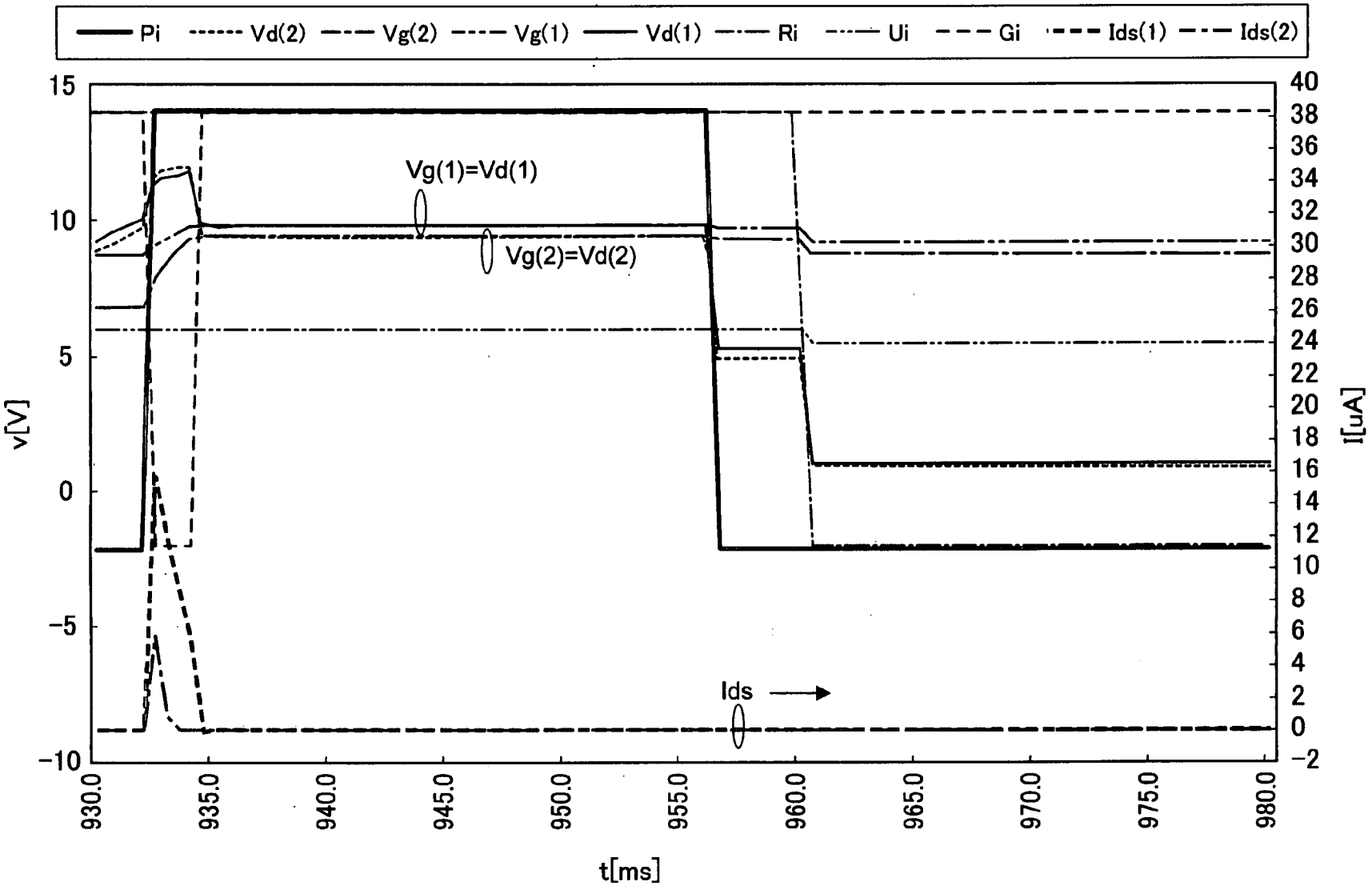
FIG. 8 is a second graph showing a result of simulating fluctuations in a gate potential Vg, a drain potential Vd, and a source-drain current Ids of the driving TFT in the pixel circuit of FIG. 4.

Further, FIG. 8 shows a result of simulating a gate potential Vg, a drain potential Vd, and a source-drain current Ids of the driving TFT: Q1 when having the state VH during the threshold compensation period. In the figure, (1) denotes the voltage and current in the case where a threshold value is at its minimum (Vth (min)) and a mobility degree p is its a maximum, while (2) denotes those in the case where the threshold value is at its maximum (Vth (max)) and the mobility degree p is at its minimum. Further, the timings of rise and fall of voltage in FIG. 8 differs from FIG. 6. However, as with FIG. 7, FIG. 8 is substantially the same as FIG. 6.

As can be seen from the simulation result in FIG. 8, even after a voltage of the control wire Ri becomes Low (GL), causing the potential wire Ui to have the potential Vc, the source-drain current Ida of the driving TFT: Q1 is 0.

As described above, according to the present embodiment, as evidenced by the timing chart in FIG. 6, a time period (selection period) during which the bit-7 data corresponding to the pixel circuit Aij is supplied to the data wire Dj is only a 4t1-6t1 period out of a 4t1-8t1 period serving as a blanking period. The 4-t1-6t1 period is allotted for a period to output a voltage of the seventh bit to the data wire Dj; however, in practice, the voltage of the data wire Dj is used for the pixel circuit Aij only in the 4t1-5t1 period during which a voltage of the gate wire Gi is Low. The 6t1-8t1 period is allotted for a period to output a voltage of the eighth bit of the pixel circuit Aij connected to another gate electrode Gi to the data wire Dj. Moreover, even when the blanking period is extended arbitrarily, the selection period is still a period of two times t1.

Thus, in the present embodiment, since only a part of the blanking period serves as the selection period, a larger number of gate wires Gi can be driven, thereby enlarging a display panel.

Note that, the time sequence pattern of FIG. 3 uses 10 gate wires in order to show the timing charts of FIGS. 4 and 5; however, as shown in FIG. 9, 320 gate wires are used to perform QVGA (vertical-type) display in actual operation.

In a time sequence pattern shown in FIG. 9, each bit length is five bit periods longer than the bit weight. This means that, as shown in a timing chart of FIG. 10, a blanking period per bit has five bit periods.

Figure 10:
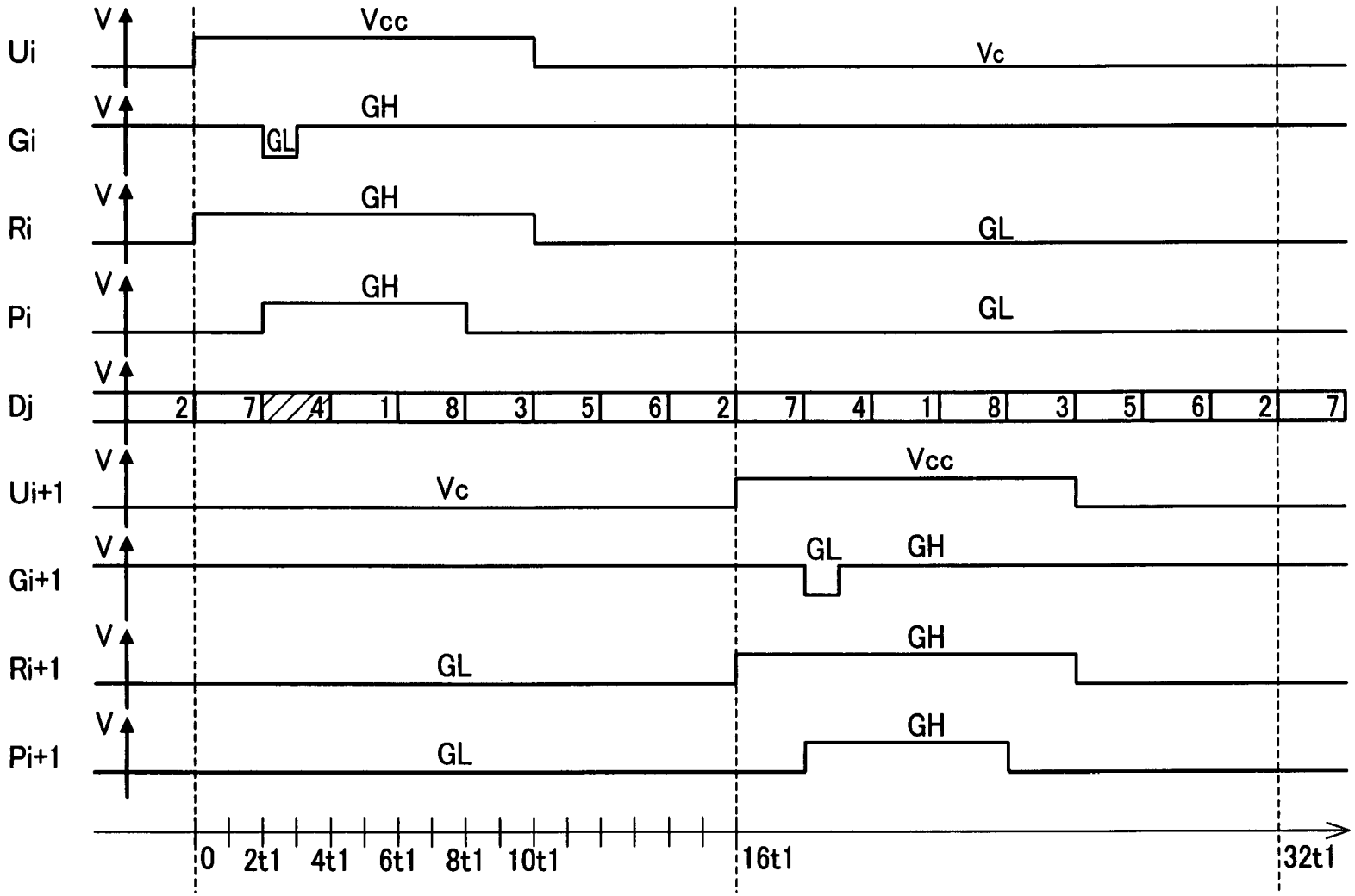
FIG. 10 is a second waveform diagram showing operating timing of the pixel circuit of FIG. 4.

FIG. 10 shows an example in which the blanking period has five selection periods. In a timing chart of FIG. 10, at the time 0, the potential wire Ui has the potential Vcc, setting a gate potential of the driving TFT: Q1 to the OFF potential, so that the blanking period is started. At the same time, a voltage of the control wire Ri becomes High (GH), putting the switching TFT: Q3 in an OFF state.

Thereafter, at the time 2t1, a voltage of the control wire Pi becomes High (GH), putting the switching TFT: Q2 in an ON state. At the same time, a voltage of the gate wire Gi becomes Low (GL), putting the switching TFT: Q4 in an ON state. Moreover, at the same time, a desired potential (a potential of the fourth bit in FIG. 10) is supplied from the data wire Dj to the gate terminal of the driving TFT: Q1. At the time 3t1, a voltage of the gate wire Gi becomes High (GH), thus putting the switching TFT: Q4 in an OFF state.

Thereafter, at the time 8t1, a voltage of the control wire Pi becomes Low (GL), putting the switching TFT: Q2 in an OFF state. In this way, a gate potential of the driving TFT: Q1 is retained in a Vp−Vth state (state VL) or a VH state (state VH).

Moreover, at the time 10t1, a voltage of the control wire Ri becomes Low (GL), putting the switching TFT: Q3 in an ON state. At the same time, a potential of the potential wire Ui is changed to the potential Vc.

In this way, after the potential wire Ui is set to the potential Vc, a current flowing through the driving TFT: Q1 in the state VL is substantially constant regardless of the threshold voltage of the driving TFT: Q1.

Further, after the potential wire Ui is set to the potential Vc, a current flowing through the driving TFT: Q1 in the state VH is 0.

In the present embodiment, the required duration of the connection between the data wire Dj and the pixel is only at least from the time that a potential corresponding to display data of each pixel is supplied to the gate terminal of the driving TFT (driving transistor) Q1 until a corresponding charge is stored in the capacitor (first capacitor) C1. Therefore, each pixel does not need to occupy a data wire in a period during which a threshold voltage of the driving TFT (driving transistor) Q1 is compensated. Thus, in the present embodiment, since a blanking period can be extended arbitrarily regardless of the length of a selection period, a larger number of gate wires Gi can be driven, thereby enlarging a display panel. The same applies to the following embodiments.

Second Embodiment

In the present embodiment, a second example of the display device according to the present invention will be described.

Since a display device 1 according to the present embodiment also has the same arrangement as shown in FIG. 2, the description is omitted.

Figure 11:
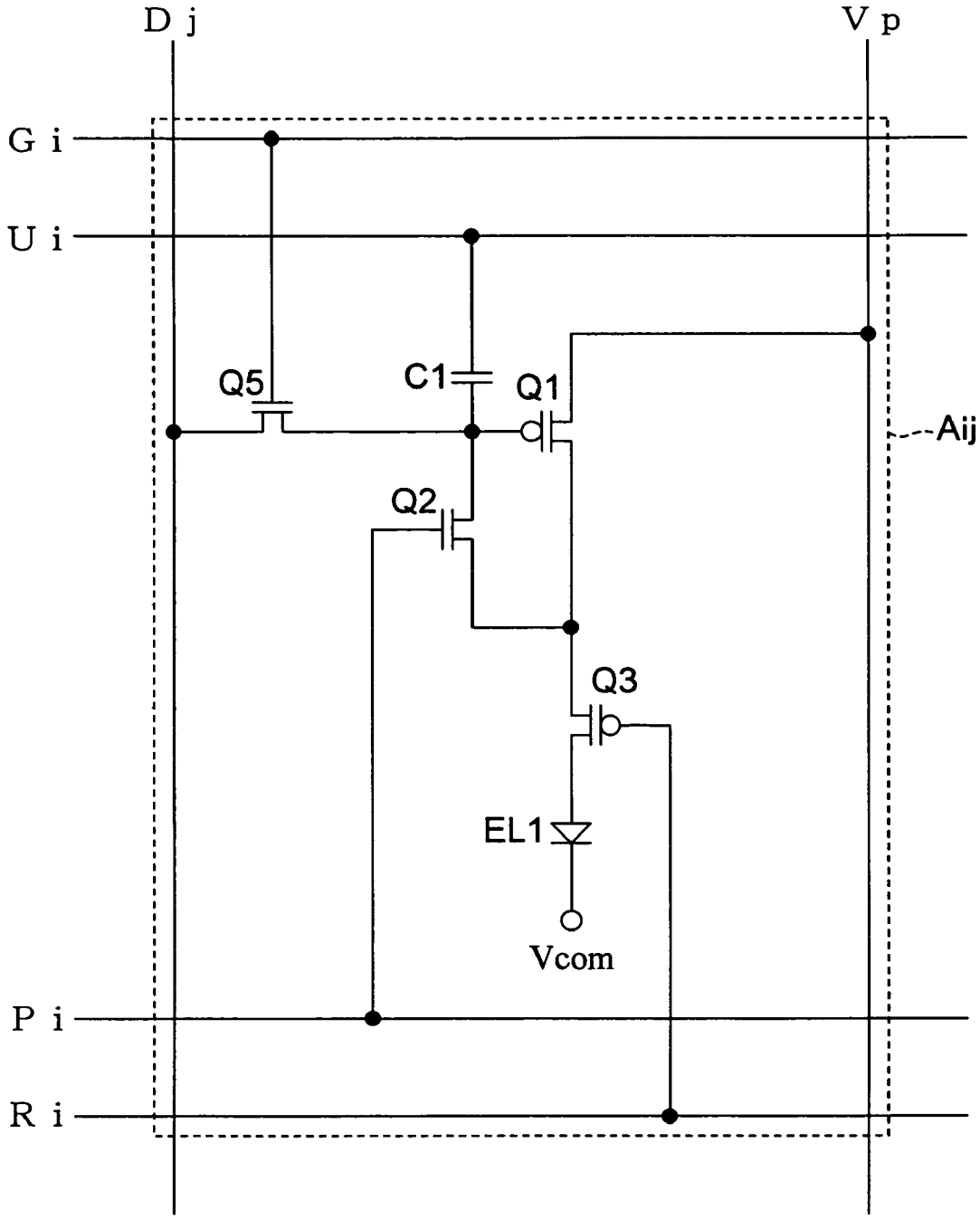
FIG. 11 is a circuit diagram showing a pixel circuit arrangement in a display device according to a Second Embodiment of the present invention.

FIG. 11 shows an arrangement of a pixel circuit Aij according to the present embodiment.

The pixel circuit Aij has an n-type switching TFT: Q5 (fourth switching transistor) disposed between a gate terminal (current control terminal) of a driving TFT: Q1 (driving transistor) and a data wire Dj instead of the switching TFT: Q4 (third switching transistor) of the pixel circuit Aij of FIG. 1. Since the pixel circuit of FIG. 11 is the same as the pixel circuit of FIG. 1 otherwise, a further description thereof is omitted here.

Operation of the pixel circuit Aij will be described below with reference to a timing chart of FIG. 12.

Figure 12:
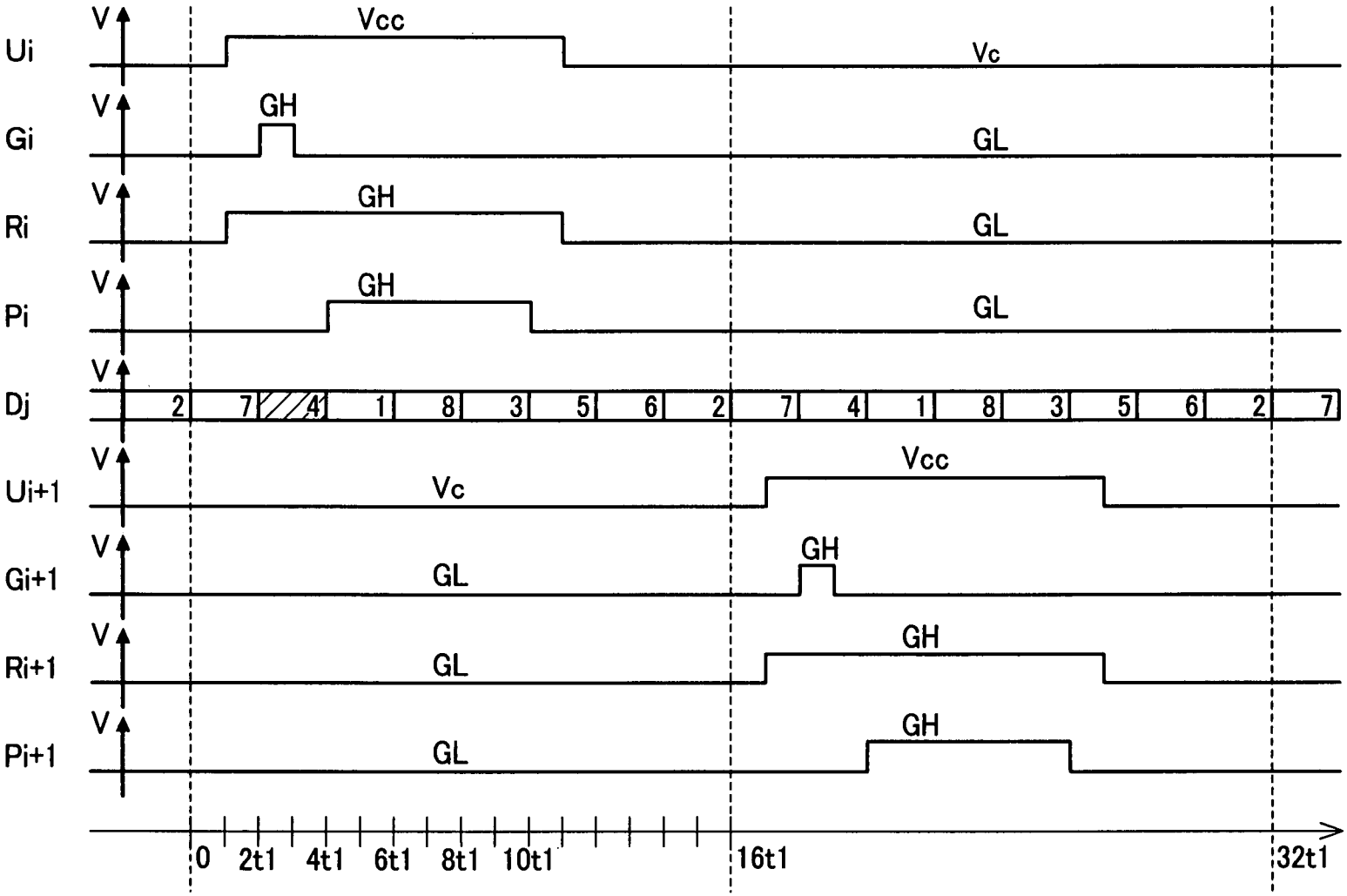
FIG. 12 is a waveform diagram showing operating timing of the pixel circuit and the driving circuit of FIG. 11.

In FIG. 12, Ui, G1, Ri, and Pi correspond to the pixel circuit Aij, and Ui+1, Gi+1, Ri+1, and Pi+1 correspond to a pixel circuit Ai+1j. Dj represents the first to eighth bit data supplied to the data wire Dj.

In the timing chart of FIG. 12, a blanking period is a t1-11t1 period during which a voltage of the control wire Ri is High or the potential wire Ui has a potential Vcc. Further, a threshold compensation period (first period) is a 4t1-10t1 period during which a voltage of the control wire Pi is High. Further, a 2t1-4t1 period is a selection period during which the fourth bit data is set in the pixel circuit Aij.

At the time t1, the potential wire Ui has the potential Vcc, setting a gate potential of the driving TFT: Q1 to the OFF potential. At the same time, a voltage of the control wire Ri becomes High (GH), putting the switching TFT: Q3 in an OFF state.

Thereafter, in a 2t1-3t1 period, a voltage of the gate wire Gi becomes High (GH), putting the switching TFT: Q5 in an ON state. Moreover, at this time, a potential supplied from the data wire Dj is set to either VL or VH depending on whether the driving TFT: Q1 is set to an ON state or to an OFF state.

That is, the following relations are satisfied, provided that a potential of the power supply wire Vp is Vp, and the (maximum) absolute value of a maximum value of variations in a threshold voltage of the driving TFT: Q1 is Vth (max), and the (minimum) absolute value of a minimum value of the variations in the threshold voltage of the driving TFT: Q1 is Vth (min).

$$VL<Vp-V\text{th(max)}$$

$$VH>Vp-V\text{th(min)}$$

For example, provided that a potential supplied from the data wire Dj is VL, a gate potential of the driving TFT: Q1 is VL. For this reason, the driving TFT: Q1 is in an ON state regardless of its threshold voltage Vth. Conversely, provided that a potential supplied from the data wire Dj is VH, a gate potential of the driving TFT: Q1 is VH. For this reason, the driving TFT: Q1 is in an OFF state regardless of its threshold voltage Vth.

Thereafter, at the time 4t1, a voltage of the control wire Pi becomes High (GH), putting the switching TFT: Q2 in an ON state. In this way, a gate potential of the driving TFT: Q1 in an ON state is changed to Vp−Vth, whereas a gate potential of the driving TFT: Q1 in an OFF state remains VH.

Thereafter, at the time 10t1, a voltage of the control wire Pi becomes Low (GL), putting the switching TFT: Q2 in an OFF state. In this way, a gate potential of the driving TFT: Q1 is retained in a Vp−Vth state (state VL) or a VH state (state VH).

Moreover, at the time 11t1, a voltage of the control wire Ri becomes Low (GL), putting the switching TFT: Q3 in an ON state, so that a potential of the potential wire Ui is changed to Vc.

At this time, when the relation:

$$VH-(Vcc-Vc)>Vp-V\text{th(min) is satisfied,}$$

the driving TFT: Q1 in the state VH remains in an OFF state. Meanwhile, a gate potential of the driving TFT: Q1 in the state VL is equal to:

$$Vp-V\text{th}-(Vcc-Vc)\text{; accordingly,}$$

a constant current flows through the driving TFT: Q1 regardless of the threshold voltage Vth of the driving TFT: Q1.

Thus, according to the present embodiment, as evidenced by the timing chart of FIG. 12, whereas the threshold compensation period occupies a 4t1-10t1 period out of the blanking period, a time period (selection period) during which the desired potential VH/VL is supplied to the data wire Dj is only a 2t1-4t1 period out of the blanking period. Moreover, even when the blanking period is extended arbitrarily, the selection period is still a period of two times t1. In the present embodiment, the threshold compensation period serving as the first period starts from the time when a potential corresponding to display data of each pixel is supplied from the data wire Dj to the gate terminal of the driving TFT: Q1 and a corresponding charge is stored in the capacitor C1. The second period starts from a time 11t1.

Thus, in the present embodiment, since only a part of the blanking period serves as the selection period, a larger number of gate wires Gi can be driven, thereby enlarging a display panel.

Figure 13:
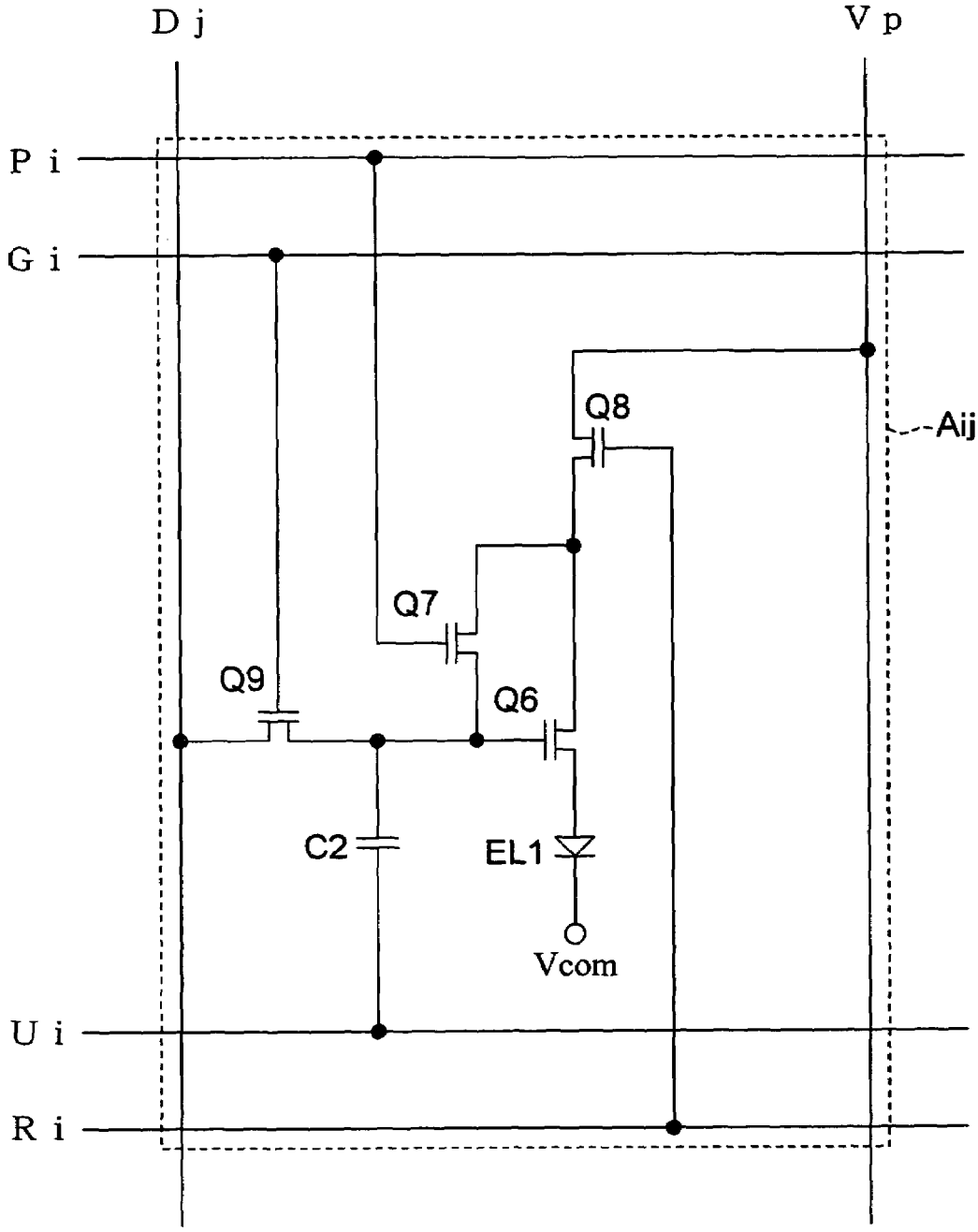
FIG. 13 is a circuit diagram showing a variation of the pixel circuit arrangement in the display device according to the Second Embodiment.

FIG. 13 shows an arrangement of a pixel circuit Aij including an n-type driving TFT: Q6 as a driving TFT.

In FIG. 13, a first switching TFT: Q8 (first switching transistor), a driving TFT: Q6 (driving transistor), and an organic EL: EL1 (electro-optic element) are serially connected in this order between a power supply wire Vp and a common electrode Vcom. Further, one terminal of a capacitor C2 (first capacitor) is connected to a gate terminal (current control terminal) of the driving TFT: Q6, and a switching TFT: Q7 (second transistor) is provided between the gate terminal of the driving TFT: Q6 and a drain terminal (current output terminal) of the driving TFT: Q6.

The other terminal of the capacitor C2 is connected to a potential wire Ui (first wire), and a switching TFT: Q9 (fourth switching transistor) is provided between the gate terminal (current control terminal) of the driving TFT: Q6 and a data wire Dj. A gate terminal of the switching TFT: Q7 is connected to the control wire Pi. A gate terminal of the switching TFT: Q8 is connected to the control wire Ri. A gate terminal of the switching TFT: Q9 is connected to the gate wire Gi.

Note the driving TFT: Q6 and the switching TFTs Q7, Q8, and Q9 are n-type TFTs.

Figure 14:
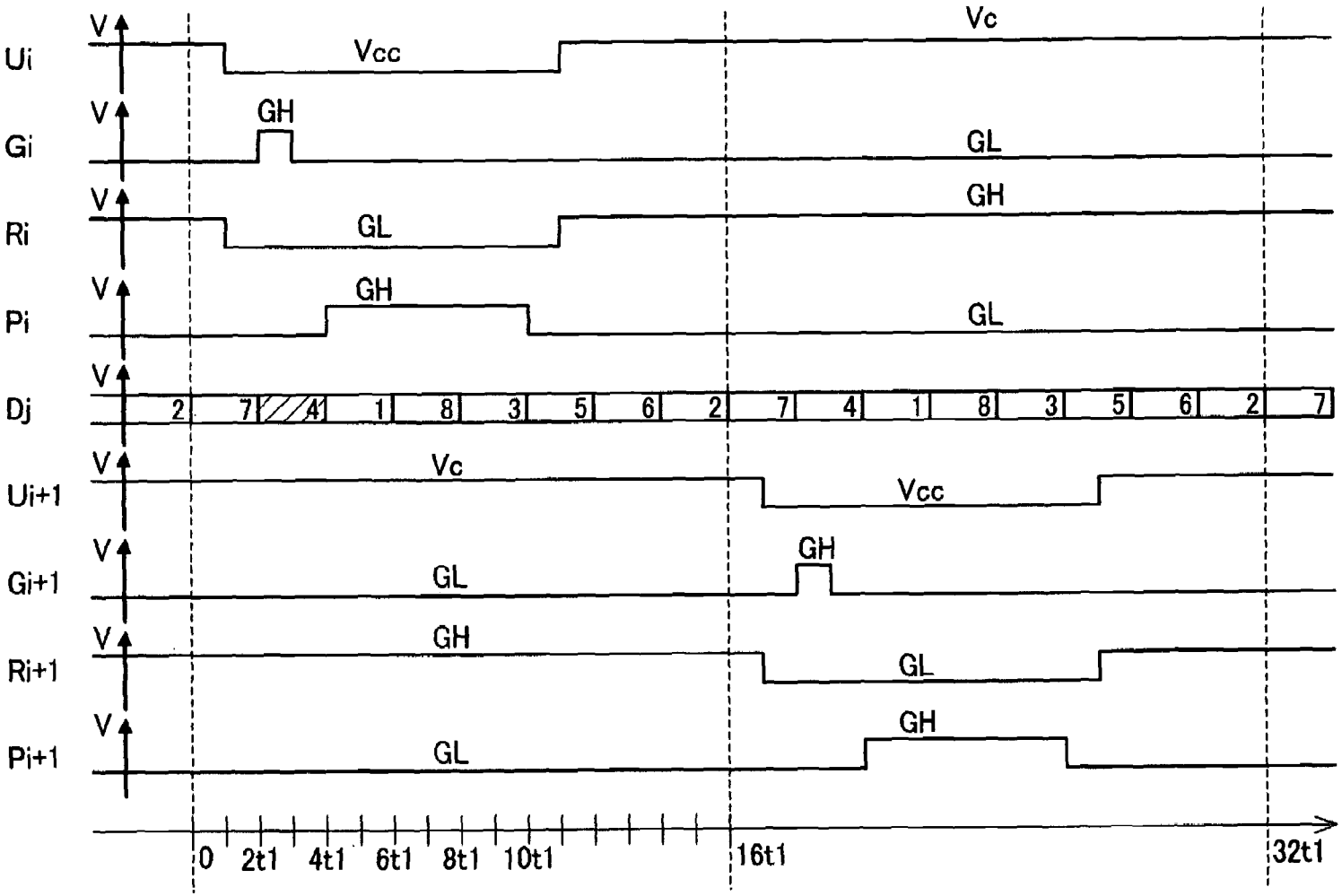
FIG. 14 is a waveform diagram showing operating timing of the pixel circuit and the driving circuit of FIG. 13.

FIG. 14 shows a timing chart of the pixel circuit Aij.

In the timing chart of FIG. 14, the driving TFT: Q6 is an n-type TFT, so Vcc<Vc. Further, since the switching TFT: Q8 (first switching transistor) connected to the control wire Ri in the pixel circuit arrangement of FIG. 13 is an n-type switching TFT, a polarity of the control wire Ri is opposite to that of the control wire Ri of FIG. 12.

Since the timing chart of FIG. 14 is the same as the timing chart of FIG. 12 otherwise, a description thereof is omitted.

Thus, the present embodiment is applicable for a structure using an n-type driving TFT, as well as that using a p-type driving TFT.

Third Embodiment

In the present embodiment, a third example of the display device according to the present invention will be described.

Since a display device 1 according to the present embodiment also has the same arrangement as shown in FIG. 2, the description thereof is omitted.

Figure 15:
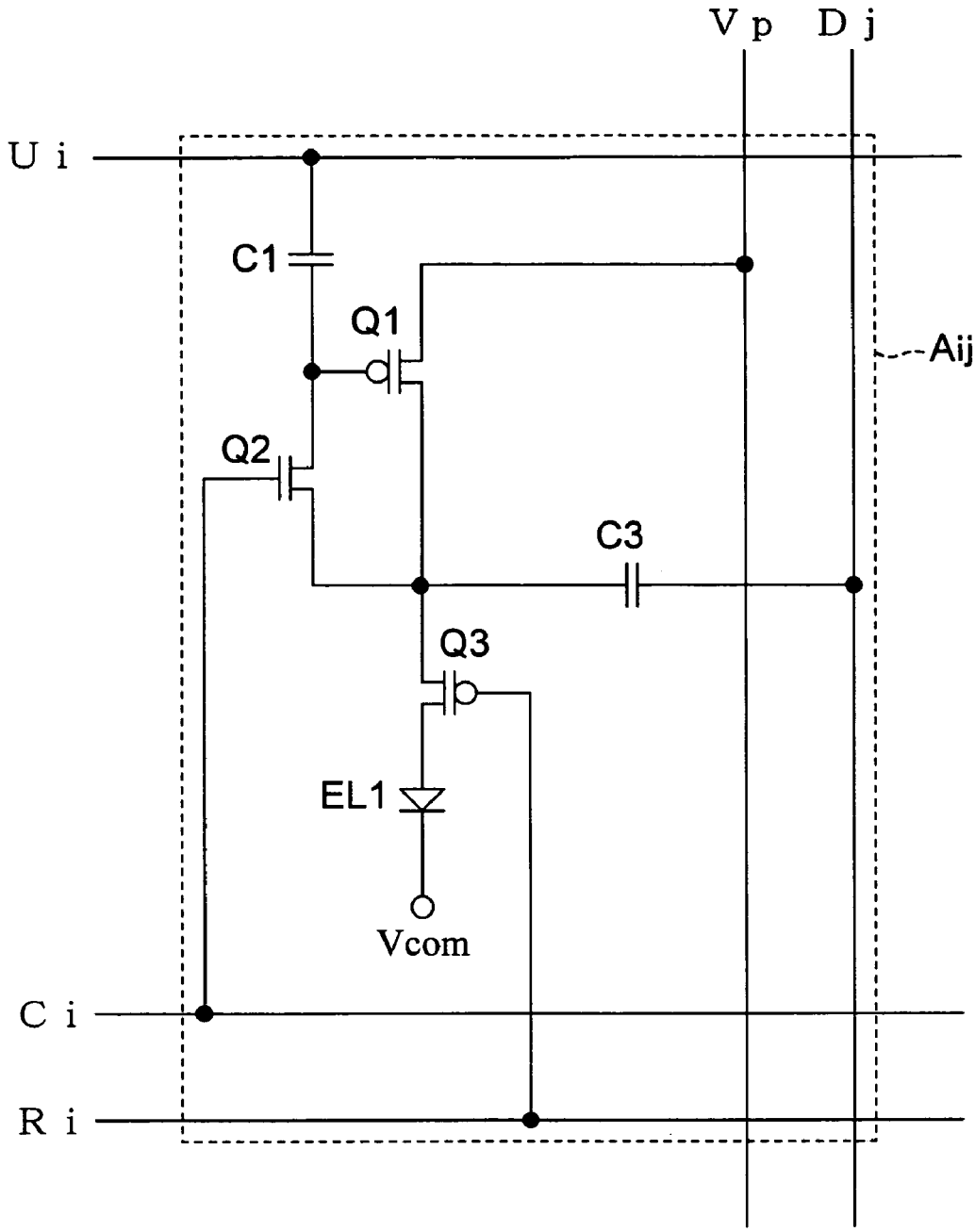
FIG. 15 is a circuit diagram showing a pixel circuit arrangement in a display device according to a Third Embodiment of the present invention.

FIG. 15 shows an arrangement of a pixel circuit Aij according to the present embodiment.

The pixel circuit Aij has a capacitor C3 (second capacitor) provided between a drain terminal (current output terminal) of a driving TFT: Q1 (driving transistor) and a data wire Dj instead of the switching TFT: Q4 (third switching transistor) of the pixel circuit Aij of FIG. 1. Further, the gate wire Gi for controlling a gate voltage of the switching TFT: Q4 is also removed. Since the pixel circuit of FIG. 15 is the same as the pixel circuit of FIG. 1 otherwise, a further description thereof is omitted here.

Operation of the pixel circuit Aij will be described below with reference to a timing chart of FIG. 16.

Figure 16:
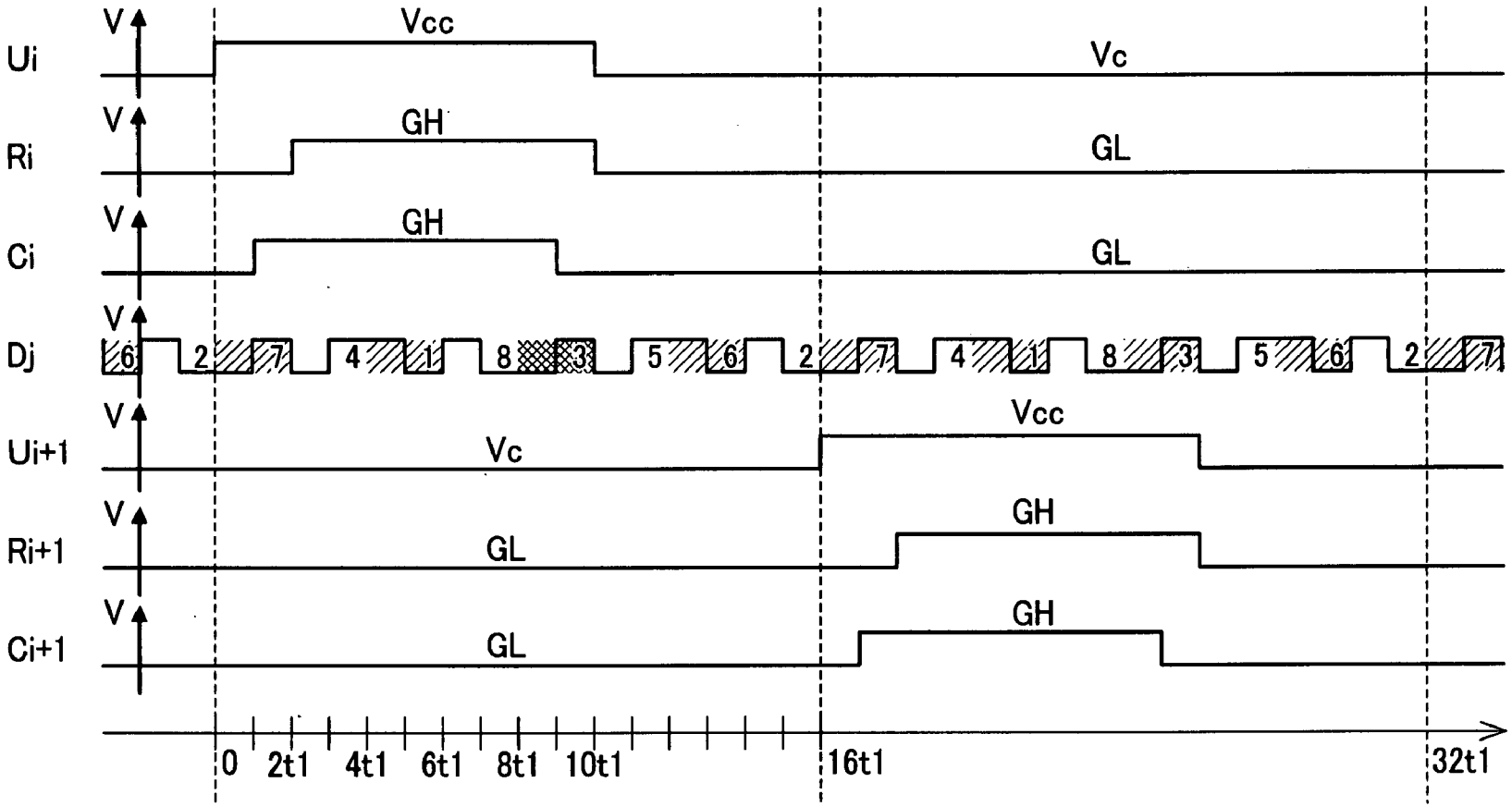
FIG. 16 is a waveform diagram showing operating timing of the pixel circuit and the driving circuit of FIG. 15.

In FIG. 16, Ui, Ri, and Ci correspond to the pixel circuit Aij, and Ui+1, Ri+1, and Ci+1 correspond to a pixel circuit Ai+1j. Dj represents the first to eighth bit data supplied to the data wire Dj.

In the timing chart of FIG. 16, a blanking period is a 0-10t1 period during which the potential wire Ui has a potential Vc. Further, as described later, a threshold compensation period (first period) is a 2t1-9t1 period. Further, an 8t1-10t1 period is a selection period during which the third bit data is set in the pixel circuit Aij.

When bit data supplied to the data wire Dj indicates OFF state, the bit data becomes VH in the first half of a selection period of two times t1 and becomes VL in the second half. When the bit data indicates ON state, the bit data becomes VL in the first half of a selection period of two times t1 and becomes VH in the second half.

Before an 8t1-10t1 selection period, at the time 0, the potential wire Ui is set to the potential Vcc so as to set the gate potential of the driving TFT: Q1 to the OFF potential. Moreover, at the time t1, a voltage of the control wire Ci becomes High (GH), putting the switching TFT: Q2 in an ON state. At this time, since a voltage of the control wire Ri remains Low (GL), the switching TFT: Q3 is in an ON state. Accordingly, a gate potential of the driving TFT: Q1 decreases, so that the driving TFT: Q1 is put in an ON state. That is, this period is a period, preceding the first period, during which the second switching transistor is put in an ON state and the first switching transistor is put in an ON state.

Thereafter, at the time 2t1, a voltage of the control wire Ri becomes High (GH), putting the switching TFT: Q3 in an OFF state. This is the start of the first period. Thereafter, every time the data wire Dj has the potential VL, a gate potential of the driving TFT: Q1 is changed by the capacitor C3. On this account, provided that a threshold voltage of the driving TFT: Q1 is Vth, a gate potential of the driving TFT: Q1 is Vp−Vth.

Accordingly, at the time 9t1, a voltage of the control signal Ci becomes Low (GL), putting the switching TFT: Q2 in an OFF state. At this time, when the potential of the data wire Dj is VL (data that turns on the third bit data) just before this, a gate potential of the driving TFT: Q2 is Vp−Vth. When a potential of the data wire Dj is VH (data that turns off the third bit data), a gate potential of the driving TFT: Q2 is Vp−Vth+(VH−VL).

Thereafter, at the time 10t1, a potential of the potential wire Ui is changed from Vcc to Vc so as to set the gate potential of the driving TFT: Q1. For this reason, when a potential of the data wire Dj is VL at the time 9t1, a gate potential of the driving TFT: Q1 is Vp−Vth−Vcc+Vc at the time 10t1, so that the driving TFT: Q1 is put in an ON state. Meanwhile, when a potential of the data wire Dj is VH at the time 9t1, a gate potential of the driving TFT: Q1 is Vp−Vth+(VH−VL)−Vcc+Vc at the time 10t1. Accordingly, provided that VH−VL>Vcc−Vc, the driving TFT: Q1 is put in an OFF state.

In this way, a potential of the potential wire Ui is changed from Vcc to Vc at the time 10t1, so that, when the potential of the data wire Dj is VL at the time 9t1, the driving TFT: Q1 is put in an ON state at the time 10t1. Further, when the potential of the data wire Dj is VH at the time 9t1, the driving TFT: Q1 is put in an OFF state at the time 10t1.

Moreover, when a potential of the data wire Dj is VL at the time 9t1, an output current of the driving TFT: Q1 is constant regardless of variations in a threshold voltage of the driving TFT: Q1.

Thus, according to the present embodiment, with the use of the pixel circuit Aij of FIG. 15, a time period (selection period) during which the desired potential VH/VL is supplied to the data wire Dj is only an 8t1-10t1 period of two times t1 out of a 0-10t1 period serving as a blanking period. Moreover, even when the blanking period is extended arbitrarily, the selection period is still a period of two times t1. In the present embodiment, the threshold compensation period serving as the first period coincides with the time (times 8t1 to 9t1) when a potential corresponding to display data of each pixel is supplied from the data wire Dj to the gate terminal of the driving TFT: Q1 and a corresponding charge is stored in the capacitor C1. The second period starts from the time 10t1.

Thus, in the present embodiment, since only a part of the blanking period serves as the selection period, a larger number of gate wires Gi can be driven, thereby enlarging a display panel.

Figure 17:
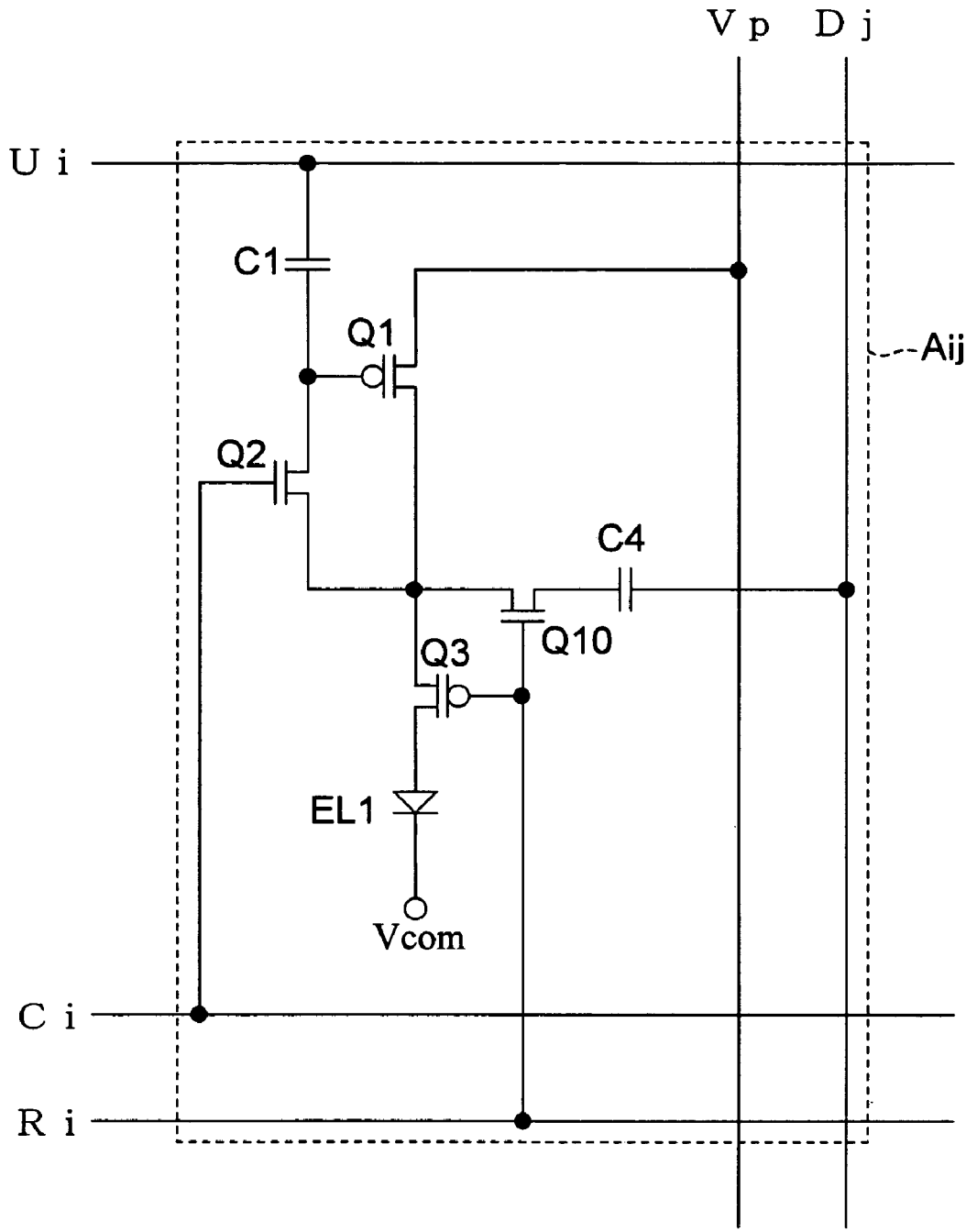
FIG. 17 is a circuit diagram showing a variation of the pixel circuit arrangement in the display device according to the Third Embodiment.

In the following, FIG. 17 shows a circuit arrangement in which a capacitor C4 (second capacitor) and a switching TFT: Q10 (eighth switching transistor) are provided between a drain terminal (current output terminal) of a driving TFT: Q1 and a data wire Dj (second wire).

When the capacitor C4 (second capacitor) connected to the data wire Dj (second wire) has a large capacitance, wiring capacity of the data wire Dj increases, so that a waveform is liable to be distorted and may not rise up within the selection period. Therefore, an effective way of preventing that from happening is to connect the switching TFT: Q10 (eighth switching transistor) serially to the capacitor C4 (second capacitor) and then disconnect the driving TFT: Q1 from the capacitor C4 while a voltage of the control wire Ri is Low. When the switching TFT: Q10 is turned OFF, the capacitor C4 and the driving TFT: Q1 are disconnected. Therefore, one terminal of the capacitor C4 is open, so that a capacitance of the capacitor C4 no longer functions as the wiring capacity of the data wire Dj.

Since a timing chart of FIG. 17 is the same as that of FIG. 16, a description thereof is omitted here.

Fourth Embodiment

In the present embodiment, a fourth example of the display device according to the present invention will be described.

Since a display device 1 according to the present embodiment also has the same arrangement as shown in FIG. 2, a description thereof is omitted.

Figure 18:
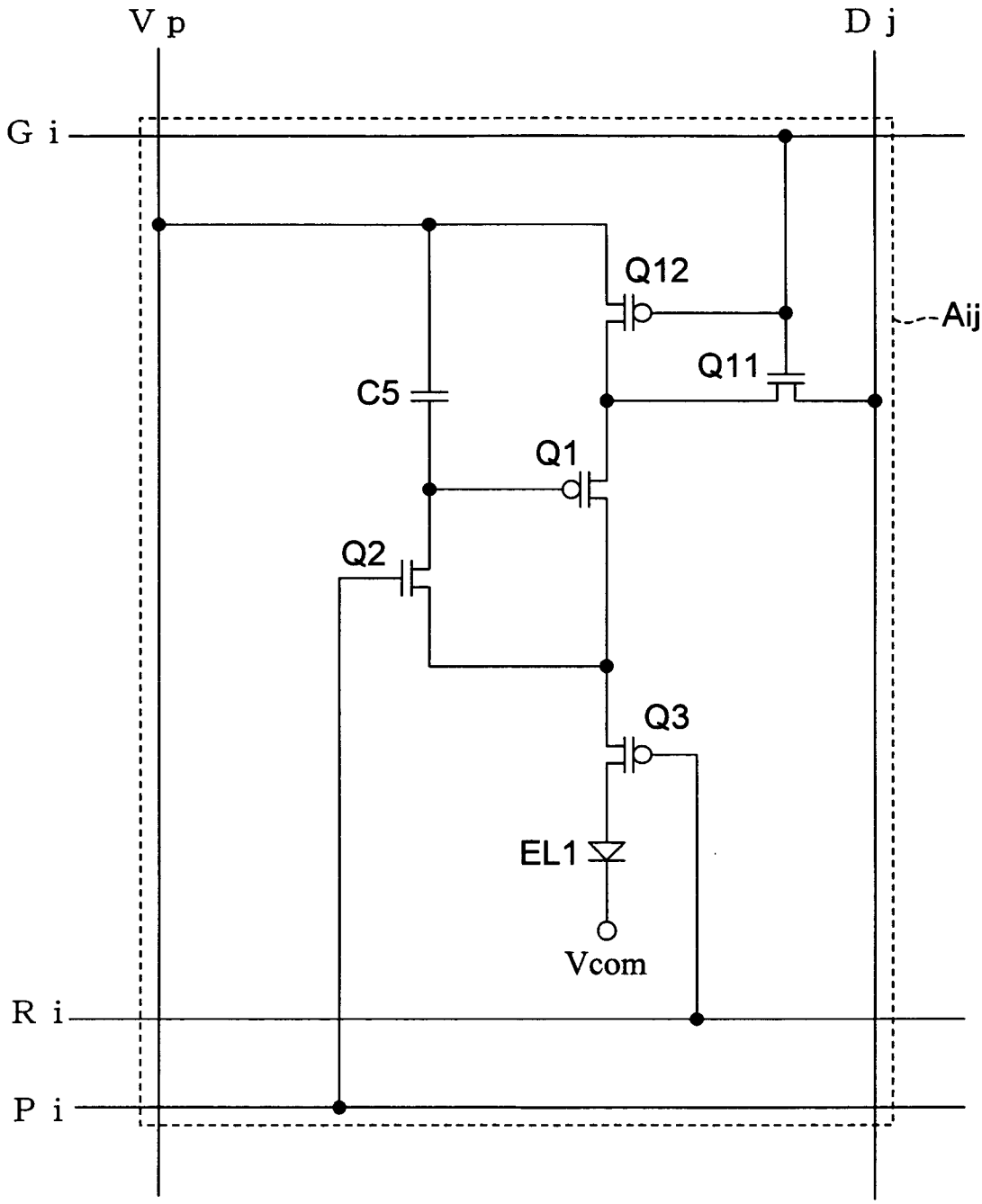
FIG. 18 is a circuit diagram showing a pixel circuit arrangement in a display device according to a Fourth Embodiment of the present invention.

FIG. 18 shows an arrangement of a pixel circuit Aij according to the present embodiment.

In the pixel circuit Aij, a driving TFT: Q1 (driving transistor) and an organic EL: EL1 (electro-optic element) are disposed near an intersection of a data wire Dj and a gate wire Gi. Moreover, a switching TFT: Q12 (sixth switching transistor), the driving TFT: Q1, a switching TFT: Q3 (first switching transistor), and the organic EL: EL1 are serially connected in this order between a power supply wire Vp and a common wire Vcom.

A capacitor C5 (first capacitor) is provided between a gate terminal (current control terminal) of the driving TFT: Q1 and the power supply wire Vp. Further, a switching TFT: Q2 (second switch transistor) is provided between the gate terminal of the driving TFT: Q1 and a drain terminal (current output terminal) of the driving TFT: Q1. Further, a switching TFT: Q11 (fifth switching transistor) is provided between a source terminal (reference potential terminal) of the driving TFT: Q1 and the data wire Dj.

A gate terminal of the switching TFT: Q2 is connected to a control wire Pi, and a gate terminal of the switching TFT: Q3 is connected to a control wire Ri. A gate terminal of each of the switching TFTs Q1 and Q12 is connected to the gate wire Gi.

Note that the driving TFT: Q1 and the switching TFTs Q3 and Q12 are p-type TFTs, and the switching TFTs Q2 and Q11 are n-type TFTs.

Operation of the pixel circuit Aij is described below with reference to a timing chart of FIG. 19.

Figure 19:
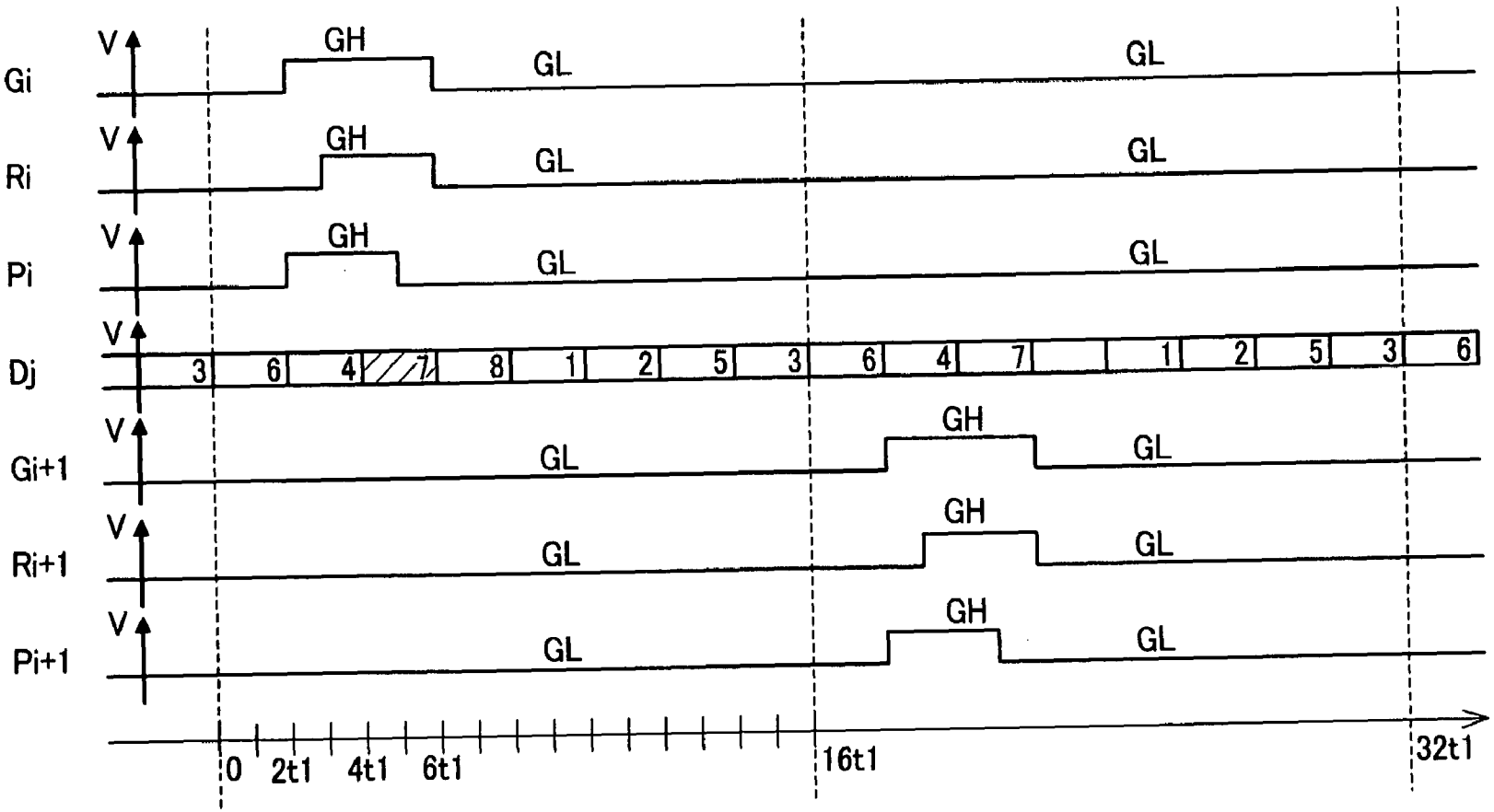
FIG. 19 is a waveform diagram showing operating timing of the pixel circuit and the driving circuit of FIG. 18.

In FIG. 19, G1, Ri, and Pi correspond to the pixel circuit Aij, and Gi+1, Ri+1, and Pi+1 correspond to a pixel circuit Ai+1j. Dj represents the first to eighth bit data supplied to the data wire Dj.

In the timing chart of FIG. 19, a blanking period is a 3t1-6t1 period during which a voltage of the control wire Ri is High. Alternatively, a 2t1-6t1 period during which a voltage of the gate wire Gi is High can be a blanking period. Further, as described later, a threshold compensation period (first period) is a 3t1-5t1 period. Further, a 4t1-6t1 period is a selection period during which the seventh bit data is set in the pixel circuit Aij.

Before the threshold compensation period (first period), at the time 2t1, a voltage of the gate wire Gi becomes High (GH), so that the switching TFT: Q12 is in an OFF state and the switching TFT: Q11 is in an ON state. Further, at the same time, a voltage of the control wire Pi becomes High (GH), putting the switching TFT: Q2 in an ON state. Since a voltage of the control wire Ri remains Low until the time 3t1, a gate potential of the driving TFT: Q1 decreases and the driving TFT: Q1 is put in an ON state. Moreover, a current flows from the data wire Dj through the switching TFT: Q11, the driving TFT: Q1, and the switching TFT: Q3 to the organic EL: EL1.

Thereafter, at the time 3t1, a voltage of the control wire Ri becomes High (GH), so that the switching TFT: Q3 is put in an OFF state. Moreover, the threshold compensation period of the driving TFT: Q1 continues from the time 4t1, at which the seventh bit data starts to be supplied to the data wire Dj, to the time 5t1, at which a voltage of the control wire Pi becomes Low (GL), putting the switching TFT: Q2 in an OFF state. Provided that a potential supplied to the data wire Dj in the end of the threshold compensation period is Vda, a gate potential of the driving TFT: Q1 is Vda−Vth. Moreover, a voltage of the control wire Pi becomes Low (GL) at the time 5t1, so that the gate potential of the driving TFT: Q1 is retained.

Thereafter, at the time 6t1, a voltage of the gate wire Gi becomes Low (GL), so that the switching TFT: Q11 is put in an OFF state and the switching TFT: Q12 is put in an ON state. As a result, a potential of the source terminal of the driving TFT: Q1 changes from the potential Vda to the potential Vp. Meanwhile, a gate potential of the driving TFT: Q1 does not change from Vda−Vth.

On this account, when the following relationship between the potential Vda supplied to the data wire Dj and the potential Vp of the power supply wire Vp in a 4t1-6t1 period serving as a selection period is expressed as: Vp>Vda, an absolute value of the gate-source voltage Vds of the driving TFT: Q1 increases by Vp−Vda, so that the driving TFT: Q1 is put in an ON state.

Conversely, when the following is other way round, i.e., Vp<Vda, an absolute value of the gate-source voltage Vds of the driving TFT: Q1 decreases by Vda−Vp, so that the driving TFT: Q1 is put in an OFF state.

On this account, a current flowing through the driving TFT: Q1 in an ON state becomes constant regardless of the threshold voltage Vth of the driving TFT: Q1. In the present embodiment, the threshold compensation period serving as the first period is completed at the time (times 4t1 to 5t1) when a potential corresponding to display data of each pixel is supplied from the data wire Dj to the gate terminal of the driving TFT: Q1, and a corresponding charge is stored in the capacitor C5.

Thus, in the present embodiment, since only a part of the blanking period serves as the selection period, a larger number of gate wires Gi can be driven, thereby enlarging a display panel.

Fifth Embodiment

In the present embodiment, a fifth example of the display device according to the present invention will be described.

Since a display device 1 according to the present embodiment also has the same arrangement as shown in FIG. 2, the description is omitted.

Figure 20:
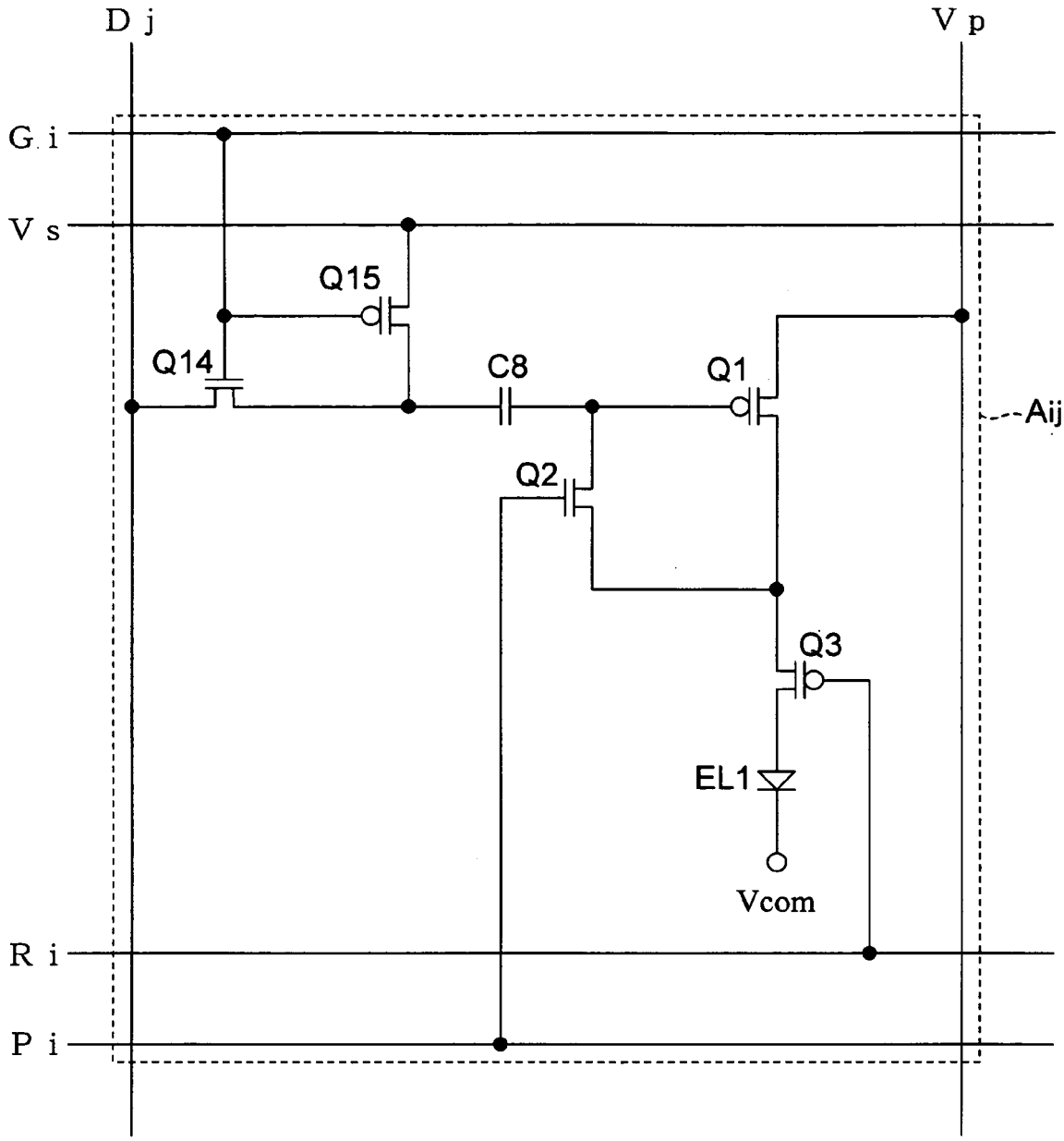
FIG. 20 is a circuit diagram showing a pixel circuit arrangement in a display device according to a Fifth Embodiment of the present invention.

FIG. 20 shows an arrangement of a pixel circuit Aij according to the present embodiment.

Also in the pixel circuit Aij, a driving TFT: Q1 (driving transistor) and an organic EL: EL1 (electro-optic element) are disposed near an intersection of a data wire Dj and a gate wire Gi.

Moreover, the driving TFT: Q1, a switching TFT: Q3 (first switching transistor), and the organic EL: EL1 are serially connected in this order between a power supply wire Vp and a common wire Vcom.

One terminal of a capacitor C8 (first capacitor) is connected to a gate terminal (current control terminal) of the driving TFT: Q1, and a switching TFT: Q15 (eighth switching transistor) is provided between the other terminal of the capacitor C8 and a potential wire Vs (second wire). Further, a switching TFT: Q14 (seventh switching transistor) is provided between the other terminal of the capacitor C8 and the data wire Dj.

Provided between the gate terminal of the driving TFT: Q1 and a drain terminal (current output terminal) of the driving TFT: Q1 is a switching TFT: Q2 (second switching transistor).

A gate terminal of the switching TFT: Q2 is connected to a control wire Pi, and a gate terminal of the switching TFT: Q3 is connected to a control wire Ri. A gate terminal of each of the switching TFTs Q14 and Q15 is connected to the gate wire Gi.

The driving TFT: Q1 and the switching TFTs Q3 and Q15 are p-type TFTs, and the switching TFTs Q2 and Q14 are n-type TFTs.

Operation of the pixel circuit Aij will be described below with reference to a timing chart of FIG. 21.

Figure 21:
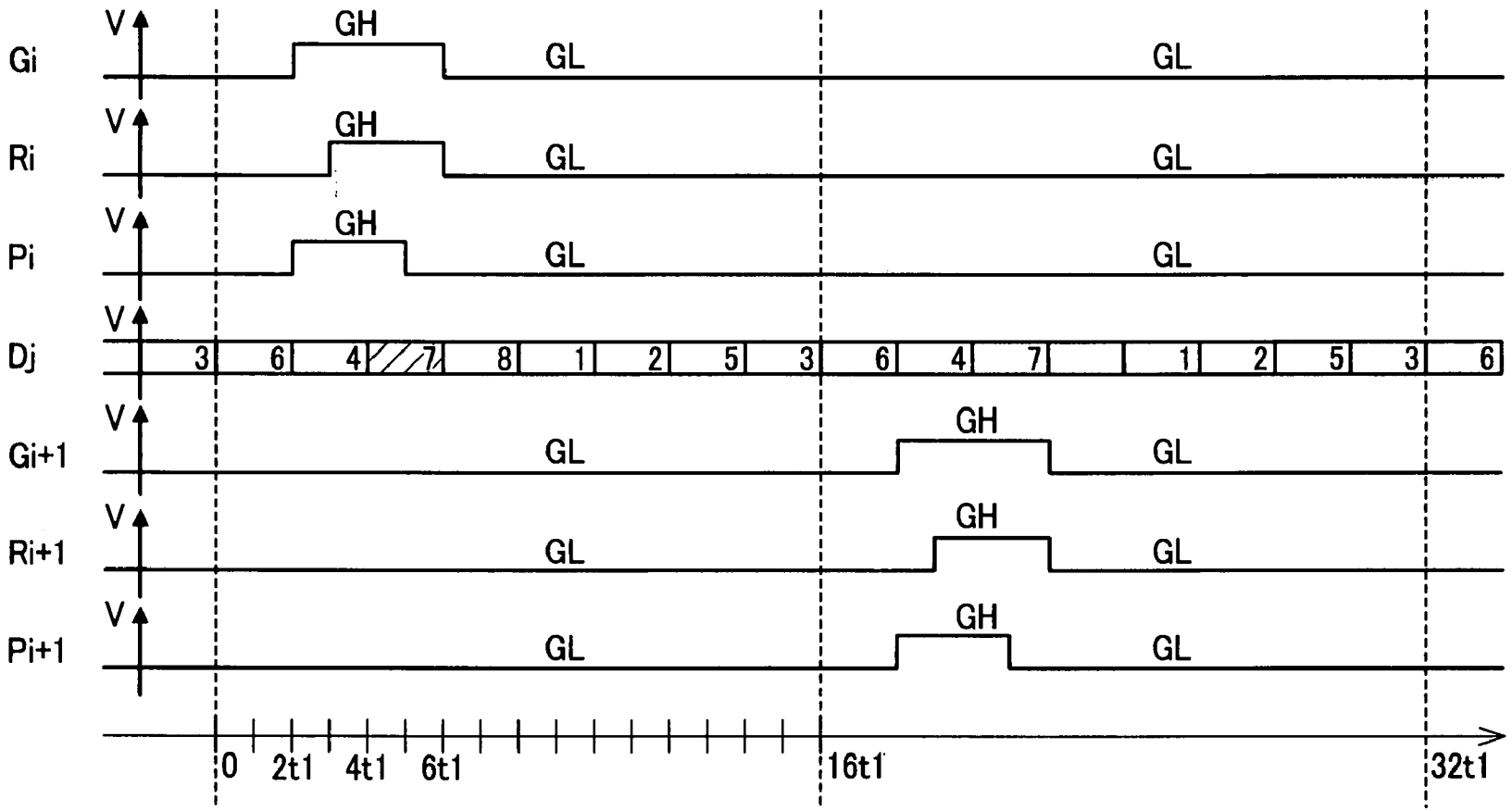
FIG. 21 is a waveform diagram showing operating timing of the pixel circuit and the driving circuit of FIG. 20.

In FIG. 21, G1, Ri, and Pi correspond to the pixel circuit Aij, and Gi+1, Ri+1, and Pi+1 correspond to a pixel circuit Ai+1j. Dj represents the first to eighth bit data supplied to the data wire Dj.

In the timing chart of FIG. 21, a blanking period is a 3t1-6t1 period during which a voltage of the control wire Ri is High. Alternatively, a 2t1-6t1 period during which a voltage of the gate wire Gi is High can be a blanking period. Further, as described later, a threshold compensation period (first period) is a 3t1-5t1 period. Further, a 4t1-6t1 period is a selection period during which the seventh bit data is set in the pixel circuit Aij.

Before the threshold compensation period (first period), at the time 2t1, a voltage of the gate wire Gi becomes High (GH), so that the switching TFT: Q15 is put in an OFF state and the switching TFT: Q14 is put in an ON state. Further, at the same time, a voltage of the control wire Pi becomes High (GH), putting the switching TFT: Q2 in an ON state. Since a voltage of the control wire Ri remains Low (GL) until the time 3t1, a gate potential of the driving TFT: Q1 decreases and the driving TFT: Q1 is put in an ON state. Moreover, a current flows from the power supply wire Vp through the driving TFT: Q1 and the switching TFT: Q3 to the organic EL: EL1.

Thereafter, at the time 3t1, a voltage of the control wire Ri becomes High (GH), so that the switching TFT: Q3 is put in an OFF state. Moreover, the threshold compensation period of the driving TFT: Q1 continues from the time 4t1, at which the seventh bit data starts to be supplied to the data wire Dj, to the time 5t1, at which a voltage of the control wire Pi becomes Low (GL) to put the switching TFT: Q2 in an OFF state.

Provided that a potential supplied in the end of the threshold compensation period to the data wire Dj is Vda, a gate potential of the driving TFT: Q1 is Vp−Vth. Moreover, a charge stored in two ends of the capacitor C8 is Vda−(Vp−Vth).

Moreover, a voltage of the control wire Pi becomes Low (GL) at the time 5t1, so that the gate potential of the driving TFT: Q1 is retained.

Thereafter, at the time 6t1, a voltage of the gate wire Gi becomes Low (GL), so that the switching TFT: Q14 is put in an OFF state and the switching TFT: Q15 is put in an ON state.

On this account, a potential of the other terminal of the capacitor C8 changes from the potential Vda to Vs.

On this account, when the following relationship between the voltage Vda supplied to the data wire Dj and the potential Vs of the potential wire Vs in a 4t1-6t1 period serving as a selection period is expressed as: Vs<Vda, an absolute value of the gate-source voltage Vds of the driving TFT: Q1 increases, so that the driving TFT: Q1 is put in an ON state.

Conversely, when the following is other way round, i.e., Vs>Vda, an absolute value of the gate-source voltage Vds of the driving TFT: Q1 decreases, so that the driving TFT: Q1 is put in an OFF state.

On this account, a current flowing through the driving TFT: Q1 in an ON state becomes constant regardless of a threshold voltage Vth of the driving TFT: Q1. In the present embodiment, the threshold compensation period serving as the first period is completed at the time (times 4t1 to 5t1) when a potential corresponding to display data of each pixel is supplied from the data wire Dj to the gate terminal of the driving TFT: Q1 and a corresponding charge is stored in the capacitor C8. The second period starts from the time 6t1.

Further, in the present embodiment, since only a part of the blanking period serves as the selection period, a larger number of gate wires Gi can be driven, thereby enlarging a display panel.

Sixth Embodiment

In the present embodiment, a sixth example of the display device of the present invention will be described.

Since a display device 1 according to the present embodiment also has the same arrangement as shown in FIG. 2, the description is omitted.

Figure 22:
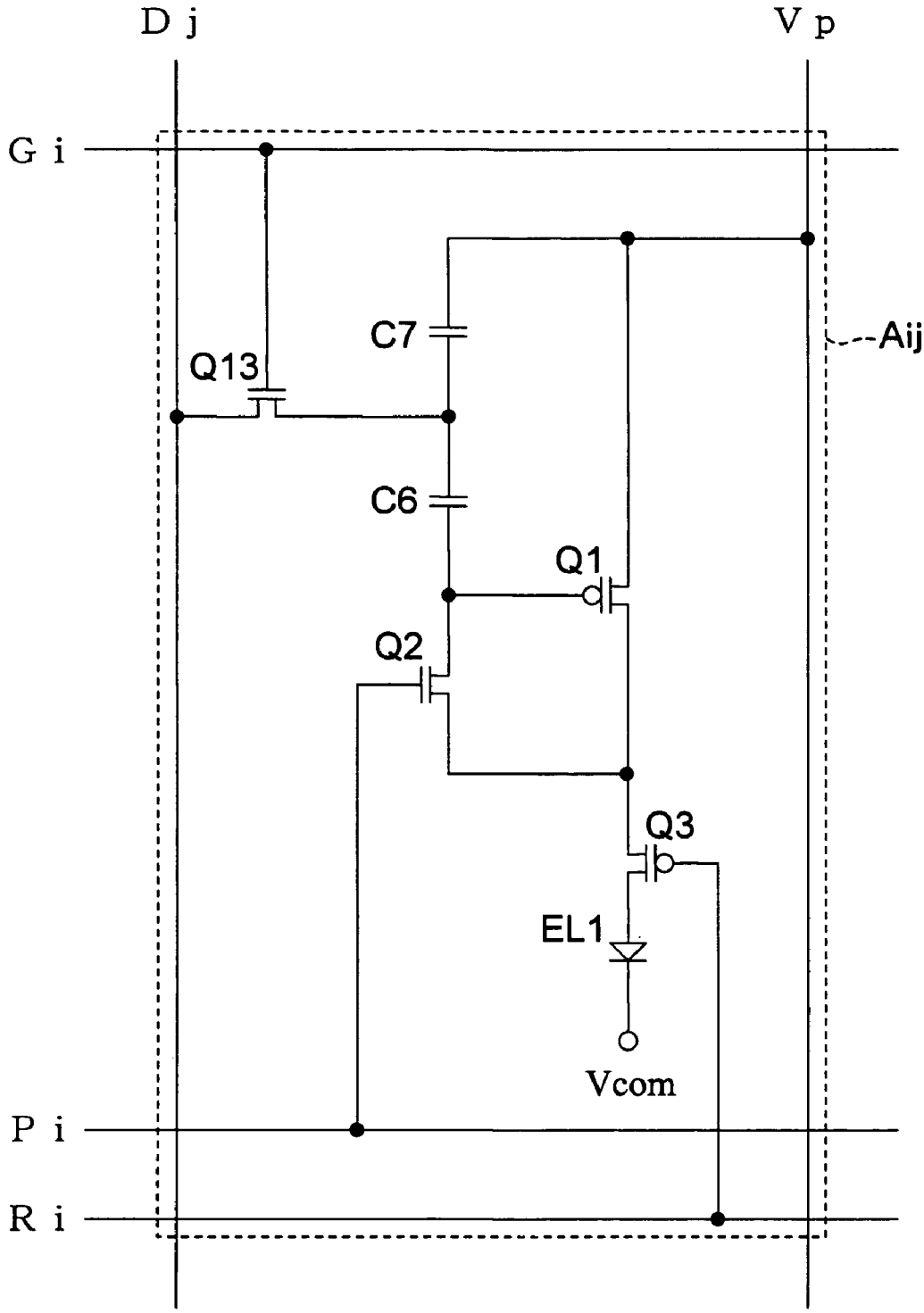
FIG. 22 is a circuit diagram showing a pixel circuit arrangement in a display device according to a Sixth Embodiment of the present invention.

FIG. 22 shows an arrangement of a pixel circuit Aij according to the present embodiment.

Also in the pixel circuit Aij, a driving TFT: Q1 (driving transistor) and an organic EL: EL1 (electro-optic element) are disposed near an intersection of a data wire Dj and a gate wire Gi. Moreover, the driving TFT: Q1, a switching TFT: Q3 (first switching transistor), and the organic EL: EL1 are serially connected in this order between a power supply wire Vp and a common wire Vcom.

One terminal of a capacitor C6 (first capacitor) is connected to a gate terminal (current control terminal) of the driving TFT: Q1, and a capacitor C7 (third capacitor) is provided between the other terminal of the capacitor C6 and the power supply wire Vp. Further, a switching TFT: Q13 (seventh switching transistor) is provided between the other terminal of the capacitor C6 and the data wire Dj. A switching TFT: Q2 (second switching transistor) is provided between the gate terminal of the driving TFT: Q1 and a drain terminal (current output terminal) of the driving TFT: Q1.

A gate terminal of the switching TFT: Q2 is connected to a control wire Pi. A gate terminal of the switching TFT: Q3 is connected to a control wire Ri. A gate terminal of the switching TFT: Q13 is connected to the gate wire Gi.

Further, the driving TFT: Q1 and the switching TFT: Q3 are p-type TFTs, and the switching TFTs Q2 and Q13 are n-type TFTs.

Note that time-sharing gradation display used in this pixel circuit arrangement is performed in accordance with a time sequence pattern shown in FIG. 23. Specifically, the first to eighth bits weigh in a ratio of 1:2:4:7:14:17:18:0. Then, the order of 8 bits for 64-gradation is rearranged in each pixel so that the bits weigh in a ratio of 18:17:1:2:7:4:14:0. The whole of the last eighth bit data whose weight is 0 is a blanking period, and the length is set to nine bit periods. The first to seventh bits have no blanking period.

Operation of the pixel circuit Aij will be described below with reference to a timing chart of FIG. 24.

Figure 24:
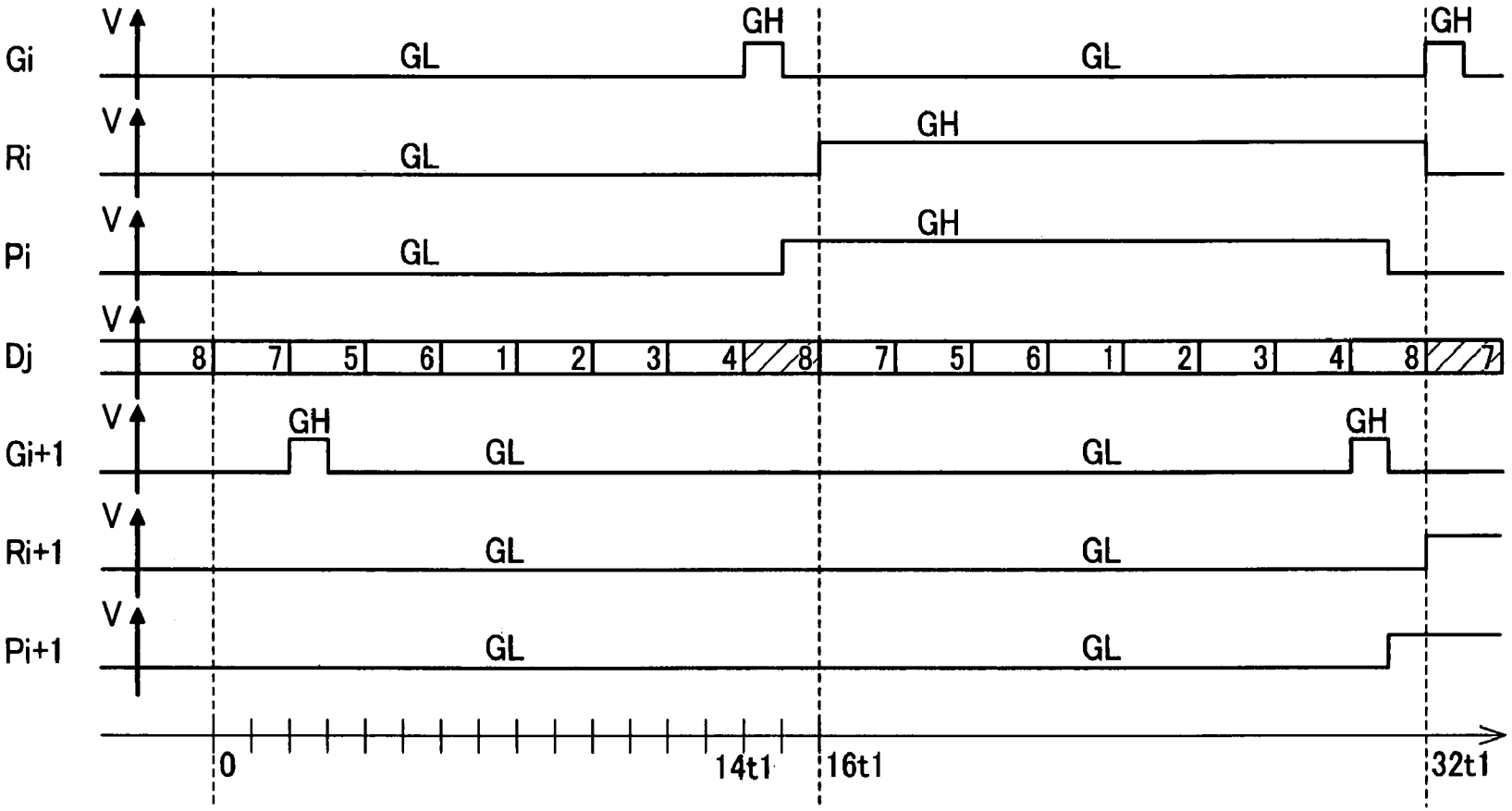
FIG. 24 is a waveform diagram showing operating timing of the pixel circuit arrangement of FIG. 22.
Figure 25:
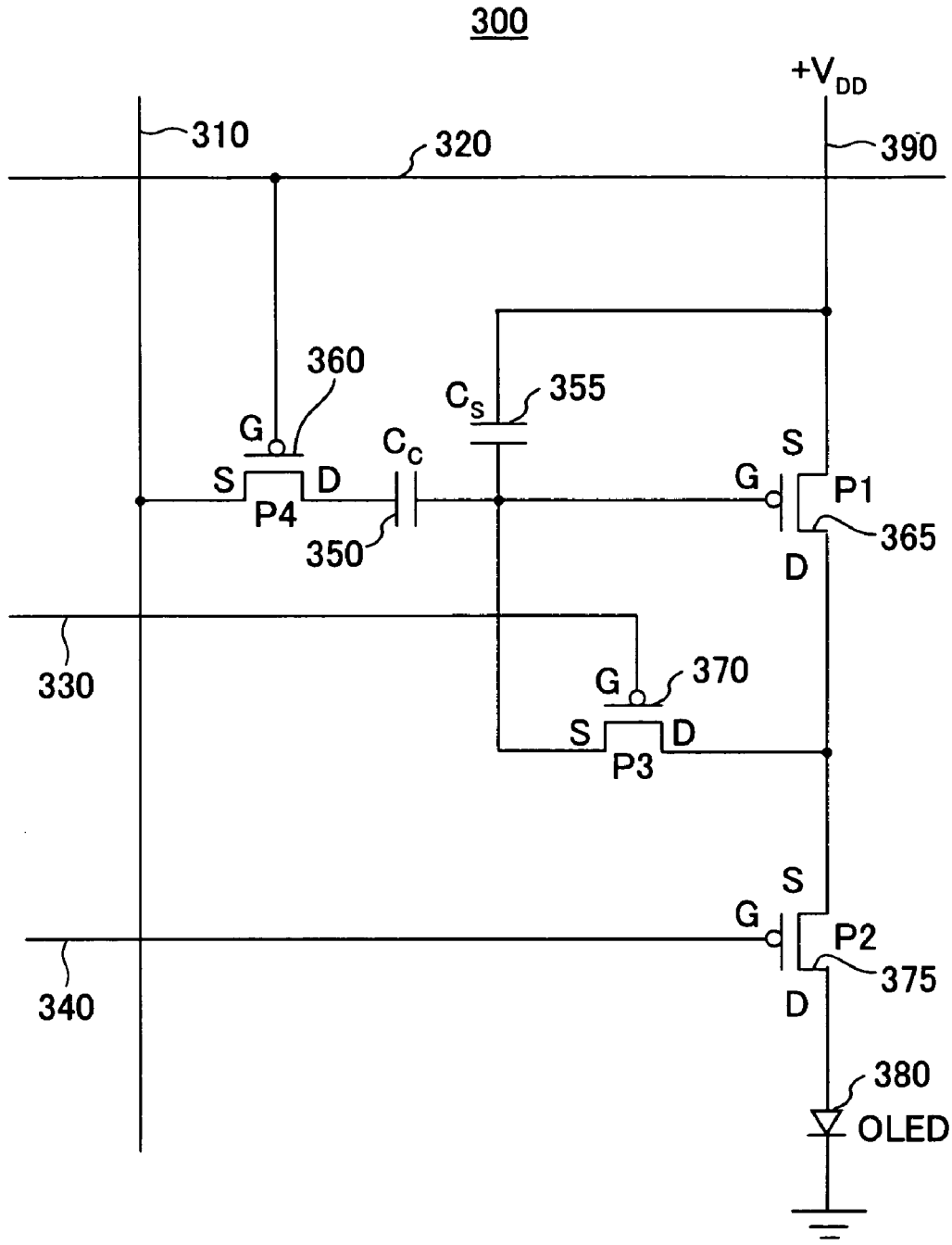
FIG. 25 is a circuit diagram showing a first arrangement example of a pixel circuit of a conventional display device.
Figure 26:
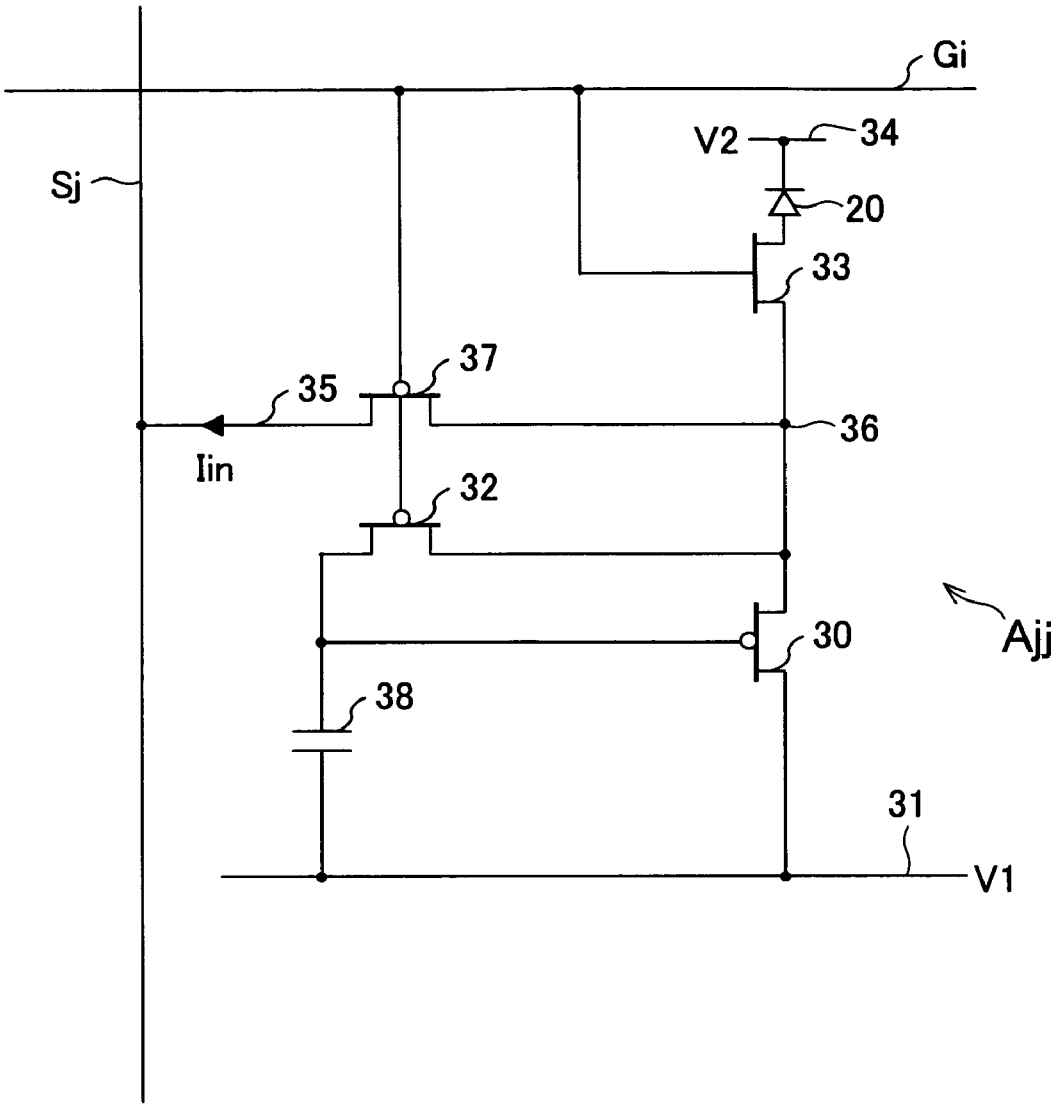
FIG. 26 is a circuit diagram showing a second arrangement example of a pixel circuit of a conventional display device.

In FIG. 24, G1, Ri, and Pi correspond to the pixel circuit Aij, Gi+1, Ri+1, and Pi+1 correspond to a pixel circuit Ai+1j. Dj represents the first to eighth bit data supplied to the data wire Dj.

A 14t1-16t1 period is a selection period during which the eighth bit data is set in the pixel circuit Aij. From the time 14t1 to the time 15t1, a voltage of the gate wire Gi becomes High (GH), putting the switching TFT: Q13 in an ON state, so that a potential Vx is inputted from the data wire Dj. Thereafter, before the threshold compensation period (first period), at the time 15t1, a voltage of the control wire Pi becomes High (GH), putting the switching TFT: Q2 in an ON state, so that a charge corresponding to the potential Vx is stored in the capacitors C6 and C7. Since a voltage of the control wire Ri remains Low (GL) until the time 16t1, a drain potential of the driving TFT: Q1 decreases. Since the drain terminal of the driving TFT: Q1 and the gate terminal of the driving TFT: Q1 are short-circuited by the switching TFT: Q2, a gate potential of the driving TFT: Q1 also decreases, and the driving TFT: Q1 is put in an ON state. Moreover, a current flows from the power supply wire Vp through the driving TFT: Q1 and the switching TFT: Q3 to the organic EL: EL1.

Thereafter, the threshold compensation period (first period) starts. At the time 16t1, a voltage of the control wire Ri becomes High (GH), putting the switching TFT: Q3 in an OFF state. Moreover, this state is retained until a voltage of the control wire Pi becomes Low (GL) at the time 31t1.

On this account, provided that a potential of the power supply wire Vp is Vp and a threshold voltage of the driving TFT: Q1 is Vth, a gate potential of the driving TFT: Q1 is Vp−Vth.

Moreover, at the time 31t1, a voltage of the control wire Pi becomes Low (GL), so that the gate potential Vp−Vth of the driving TFT: Q1 is retained.

In the present embodiment, in order to set a potential across the two ends of the capacitor C6, the eighth bit data whose whole period serves as a blanking period is necessary.

That is, VH is used as the eighth bit data to set at Vp−VH the potential difference across the two ends of the capacitor C7 (in FIG. 24, the setting period is a 14t1-15t1 period). Thereafter, as shown in FIG. 24, during a 16t1-31t1 period (which may be of any length as long as it is within a blanking period), a voltage of the control wire Pi becomes High, putting the switching TFT: Q2 in an ON state, so that a threshold of the driving TFT: Q1 is compensated. As a result, a potential difference across the two ends of the capacitor C6 becomes VH−(Vp−Vth).

Thus, there is no blanking period during which other bit data is written. Therefore, in the present embodiment, the eighth bit data display period (between the time 14t1 and the time 32t1) is used as a blanking period to compensate the threshold of the driving TFT: Q1.

Next, the second period starts. At the time 32t1, a voltage of the control wire Ri becomes Low (GL), putting the switching TFT: Q3 in an ON state. Further, from the time 32t1 to the time 33t1, a voltage of the gate wire Gi becomes High (GH), putting the switching TFT: Q13 in an ON state, so that a potential Vda corresponding to the seventh bit is supplied from the data wire Dj to the capacitors C6 and C7.

When the following relationship between the potential Vda and the preceding potential Vx is expressed as: Vx>Vda, an absolute value of a gate-source voltage Vgs of the driving TFT: Q1 increases, so that the driving TFT: Q1 is put in an ON state.

Conversely, when the following is other way round, i.e., Vx<Vda, an absolute value of a gate-source voltage Vgs of the driving TFT: Q1 decreases, so that the driving TFT: Q1 is put in an OFF state.

Display of the first to seventh bits will be described in detail below.

As shown in FIG. 24, when a voltage of the gate wire Gi is High, the switching TFT: Q13 is turned ON, and a potential of the capacitor C7 is substituted by VH or VL.

At this time, a charge of the capacitor C6 does not change. Therefore, with the potential VH (OFF), a gate potential of the driving TFT: Q1 is Vp−Vth (Vth>0). That is, the potential across the two ends of the capacitor C6 at this time is VH−(Vp−Vth). On the other hand, with the potential VL (ON), a gate potential of the driving TFT: Q1 is Vp−Vth−VH+VL (Vth>0).

Because of the relation: VH>VL, a gate potential of the driving TFT: Q1 has a voltage (i.e., ON voltage) lower than Vp−Vth.

Thus, a gate potential of the driving TFT: Q1 is determined according to a potential of the data wire Dj when the voltage of the gate wire Gi is High.

In the present embodiment, when the potential corresponding to display data of each pixel, which is substituted by a potential of the eighth bit data, is supplied from the data wire Dj to the gate terminal of the driving TFT: Q1, and the corresponding charge is stored in the capacitor C1, the threshold compensation period, which serves as the first period, is started. Then, when the voltage of the gate wire Gi becomes High with respect to each of the first to seventh bits (a period starting from the time 32t1 in the seventh bit of FIG. 24), the second period is started.

Thus, in the present embodiment, since only a part of the threshold compensation period serves as the selection period, a larger number of gate wires Gi can be driven, thereby enlarging a display panel. Thus, an effect of the present invention is obvious.

The descriptions of all embodiments have been completed.

As described above, according to a display device of the present invention and a method for driving the same, each pixel does not need to occupy the data wire (data wire Dj) in the period during which a threshold voltage of a driving transistor (Q1) is compensated. For this reason, a selection period per pixel can be shortened, thereby displaying a larger number of pixels.

Particularly, when time-sharing gradation display is performed by switching the output state of the driving transistor (Q1) multiple times per frame, it is required to reduce the period (selection period) in which the data wire (data wire Dj) is occupied in order to set the output state of the driving transistor (Q1).

For example, in order to perform QVGA display with 8-bit gradation, the occupied time of the data wire (date wire Dj) per switching needs to be fall within the following condition.

$$1/(60\times320\times8)\approx6.5\ \mu s$$

Here, "60" is the number of frames per second, and "320" is the number of lines according to FIG. 9, and "8" is the number of time periods per occupied time according to FIG. 4.

However, with the conventional pixel circuit arrangement and the conventional method for driving the same, a time period during which the data wire (data wire Dj) is occupied once requires several tens of microseconds (μs). This means that QVGA display cannot be performed.

In contrast, with the present invention, the occupied time of a data wire (data wire Dj) per switching falls within several microseconds, thereby enabling QVGA display.

Thus, the use of the present invention allows a display panel to be enlarged. Therefore, an effect of the present invention is obvious.

As described above, the display device of the present invention includes: an electro-optic element, being a current-driven type, which serves as a display light source; a driving transistor for supplying an output current from a current output terminal to the electro-optic element as a driving current for driving the electro-optic element, the output current being controlled by a voltage which is applied between a current control terminal and a reference potential terminal; a first switching transistor; a second switching transistor; and a first capacitor, the electro-optic element and the driving transistor being disposed in each of a plurality of pixels which are aligned in a matrix manner, and the driving current corresponding to display data supplied from a data wire to the pixel, wherein: the driving transistor, the first switching transistor, and the electro-optic element are serially connected, and the current control terminal of the driving transistor is connected to a first terminal of the first capacitor, and the second switching transistor is provided between the current control terminal and the current output terminal of the driving transistor, and the second switching transistor is put in an ON state and the first switching transistor is put in an OFF state in a first period which starts from a time when a potential corresponding to display data of the pixel is supplied from the data wire to the current control terminal of the driving transistor and a corresponding charge is stored in the first capacitor, and the output current of the driving transistor is adjusted in a second period by changing a potential of a second terminal of the first capacitor or a potential of the reference potential terminal of the driving transistor.

With this structure, it is possible to provide a display device which makes it possible to shorten a selection period per pixel while compensating variations in the threshold voltage of the driving transistor.

Further, in order to solve the foregoing problems, the display device of the present invention is arranged so that the other terminal of the first capacitor is connected to a first wire.

According to the foregoing invention, the first wire is connected to the other terminal of the first capacitor, and a potential of the first wire is changed in the second period so as to change a potential of the current control terminal of the driving transistor. This brings about an effect of setting an output current of the driving transistor to a desired value.

In order to solve the foregoing problems, the display device of the present invention further includes a third switching transistor provided between the current output terminal of the driving transistor and the data wire.

According to the foregoing invention, in the first period, after the first switching transistor is put in an OFF state, the second switching transistors can be put in an ON state, and then the third switching transistor can be put in an ON state. At this time, a potential Vda is supplied to the current control terminal of the driving transistor through the third switching transistor. Controlling of the potential Vda brings about an effect of controlling an ON/OFF state of the driving transistor without flowing a current into the electro-optic element in the first period.

For example, when the driving transistor is a p-type transistor, and a potential of the reference potential terminal is Vs, the driving transistor (Q1) is in an OFF state regardless of its threshold voltage as long as the potential Vda, with respect to the smallest threshold voltage −Vth (min) of the driving transistor, satisfies the following condition.

$$Vs-V\text{th}(\text{min})<Vda \quad \text{(Condition 1)}$$

Conversely, the driving transistor is in an ON state regardless of its threshold voltage as long as the potential Vda, with respect to the largest threshold voltage −Vth (max) of the driving transistor, satisfies the following conditions.

$$Vs-V\text{th}(\text{max})>Vda \quad \text{(Condition 2)}$$

Thereafter, the third switching transistor is put in an OFF state. At this time, under Condition 1, the driving transistor is put in an OFF state, and a potential of the current control terminal of the driving transistor remains the potential Vda. Under Condition 2, the driving transistor is put in an ON state, and a potential of the current control terminal of the driving transistor becomes Vs−Vth.

Moreover, in the second period, the potential of the current control terminal of the driving transistor or a potential of the reference potential terminal of the driving transistor is changed. On this account, a constant current can be flown through the driving transistor, whose current control terminal has the potential Vs−Vth, regardless of its threshold voltage.

Further, when the potential Vs changes to a potential Vs−Vx, an output state of the driving transistor, whose current control terminal has the potential Vda, remains OFF as long as the following equation is satisfied.

$$Vs-V\text{th}(\text{min})<Vda-Vx$$

In order to solve the foregoing problems, the display device of the present invention further includes a fourth switching transistor provided between the current control terminal of the driving transistor and the data wire.

According to the foregoing invention, in the first period, the first switching transistor is put in an OFF state before the fourth switching transistor is put in an ON state. Moreover, in the beginning of the first period, the potential Vda is supplied to the current output terminal of the driving transistor through the fourth switching transistor. Controlling of the potential Vda brings about an effect of controlling an ON/OFF state of the driving transistor in the first period without flowing a current into the electro-optic element.

In order to solve the foregoing problems, the display device of the present invention further includes a second capacitor through which the current output terminal of the driving transistor and the data wire are connected.

According to the foregoing invention, in the first period, the second switching transistor is put in an ON state before the first switching transistor is put in an OFF state. For this reason, the driving transistor is once put in an ON state, and a current flows into the electro-optic element. Thereafter, the driving transistor is put in an OFF state.

Thereafter, immediately before the second switching transistor is put in an OFF state, a potential of the data wire becomes High, so that the current control terminal of the driving transistor has a potential larger than the threshold voltage Vs−Vth, and the OFF potential is retained in the current control terminal of the driving transistor.

Conversely, immediately before the second switching transistor is put in an OFF state, the potential of the data wire remains Low, so that the current control terminal of the driving transistor retains the threshold voltage Vs−Vth.

Thereafter, the second switching transistor is put in an OFF state, so that the potential is retained. This brings about an effect of controlling an ON/OFF state of the driving transistor and an effect of supplying a constant current to the driving transistor in an ON state regardless of its threshold voltage.

Note that by putting in an OFF state a switching transistor serially connected to the second capacitor, the capacitance conducted to the data wire can be decreased. This brings about an effect of decrease of the load on the source driver circuit in the second period, which accelerate change in potential of the data wire.

In order to solve the foregoing problem, the display device of the present invention further includes: a fifth switching transistor provided between the reference potential terminal of the driving transistor and the data wire; and a sixth switching transistor provided between the reference potential terminal of the driving transistor and a power supply wire for supplying a power supply potential which generates the output current of the driving transistor.

According to the present invention, in the first period, a potential of the current control terminal of the driving transistor is larger (or smaller) than a potential of the data wire by the threshold potential Vth. Moreover, in the second period, a potential of the reference potential of the driving transistor is changed. This brings about an effect that the output current of the driving transistor can be set to a desired current value.

In order to solve the foregoing problem, the display device of the present invention further includes: a third capacitor provided between the second terminal of the first capacitor and the power supply wire for supplying a power supply potential which generates the output current of the driving transistor; and a seventh switching transistor provided between the second terminal of the first capacitor and the data wire.

According to the foregoing invention, in the first period, a potential of the current control terminal of the driving transistor becomes larger (or smaller) than the potential Vs of the reference potential terminal of the driving transistor by the threshold potential Vth. Moreover, in the second period, a potential of the other terminal of the first capacitor is changed. This brings about an effect that the output current of the driving transistor can be set to a desired current value.

In order to solve the foregoing problems, the display device of the present invention further includes: an eighth switching transistor provided between the second terminal of the first capacitor and a second wire for supplying a predetermined potential; and a seventh switching transistor provided between the second terminal of the first capacitor and the data wire.

According to the foregoing invention, in the first period, a potential of the current control terminal of the driving transistor becomes larger (or smaller) than the potential Vs of the reference potential terminal of the driving transistor by the threshold potential Vth. Moreover, in the second period, a potential of the second terminal of the first capacitor is changed. This brings about an effect that the output current of the driving transistor can be set to a desired current value.

Further, the potential of the second wire may be fixed or unified for all colors of RGB (red-green-blue).

In order to solve the foregoing problems, a method of the present invention for driving a display device is a method for driving a display device which includes: an electro-optic element, being a current-driven type, which serves as a display light source; a driving transistor for supplying an output current from a current output terminal to the electro-optic element as a driving current for driving the electro-optic element, the output current being controlled by a voltage which is applied between a current control terminal and a reference potential terminal; a first switching transistor; a second switching transistor; and a first capacitor, the electro-optic element and the driving transistor being disposed in each of a plurality of pixels which are aligned in a matrix manner, and the driving current corresponding to display data supplied from a data wire to the pixel, wherein: the driving transistor, the first switching transistor, and the electro-optic element are serially connected, and the current control terminal of the driving transistor is connected to a first terminal of the first capacitor, and the second switching transistor is provided between the current control terminal and the current output terminal of the driving transistor, said method comprising the steps of: putting the second switching transistor in an ON state and putting the first switching transistor in an OFF state in a first period which starts from or coincides with a time when a potential corresponding to display data of the pixel is supplied from the data wire to the current control terminal of the driving transistor and a corresponding charge is stored in the first capacitor; and adjusting the output current of the driving transistor by changing a potential of a second terminal of the first capacitor or a potential of the reference potential terminal of the driving transistor in a second period.

According to the foregoing invention, the pixel does not need to occupy the data wire in the period during which a threshold voltage of the driving transistor is compensated. On this account, a display device achieves reduction of selection period per pixel while compensating variations in the threshold voltage of the driving transistor.

The present invention can be applied to various display devices using current-driven electro-optic elements.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display device, comprising:

an electro-optic element, being a current-driven type, which serves as a display light source;

a driving transistor for supplying an output current from a current output terminal to the electro-optic element as a driving current for driving the electro-optic element, the output current being controlled by a voltage which is applied between a current control terminal and a reference potential terminal;

a first switching transistor;

a second switching transistor; and a first capacitor, the electro-optic element and the driving transistor being disposed in each of a plurality of pixels which are aligned in a matrix manner, and the driving current corresponding to display data supplied from a data wire to the pixel, wherein:

the driving transistor, the first switching transistor, and the electro-optic element are serially connected, and the current control terminal of the driving transistor is connected to a first terminal of the first capacitor, and the second switching transistor is provided between the current control terminal and the current output terminal of the driving transistor, and the second switching transistor is put in an ON state and the first switching transistor is put in an OFF state in a first period which starts from a time when a potential corresponding to display data of the pixel is supplied from the data wire to the current control terminal of the driving transistor and a corresponding charge is stored in the first capacitor, and the output current of the driving transistor is adjusted in a second period by changing a potential of a second terminal of the first capacitor or a potential of the reference potential terminal of the driving transistor.

2. The display device according to claim 1, wherein the second terminal of the first capacitor is connected to a first wire.

3. The display device according to claim 2, further comprising a third switching transistor provided between the current output terminal of the driving transistor and the data wire.

4. The display device according to claim 1, further comprising a fourth switching transistor provided between the current control terminal of the driving transistor and the data wire.

5. The display device according to claim 1, further comprising a third switching transistor provided between the current output terminal of the driving transistor and the data wire.

6. The display device according to claim 1, further comprising a fourth switching transistor provided between the current control terminal of the driving transistor and the data wire.

7. A display device, comprising:

an electro-optic element, being a current-driven type, which serves as a display light source;

a driving transistor for supplying an output current from a current output terminal to the electro-optic element as a driving current for driving the electro-optic element, the output current being controlled by a voltage which is applied between a current control terminal and a reference potential terminal;

a first switching transistor;

a second switching transistor; and a first capacitor, the electro-optic element and the driving transistor being disposed in each of a plurality of pixels which are aligned in a matrix manner, and the driving current corresponding to display data supplied from a data wire to the pixel, wherein:

the driving transistor, the first switching transistor, and the electro-optic element are serially connected, and the current control terminal of the driving transistor is connected to a first terminal of the first capacitor, and the second switching transistor is provided between the current control terminal and the current output terminal of the driving transistor, and the second switching transistor is put in an ON state and the first switching transistor is put in an ON state before a first period, and the second switching transistor is put in an ON state and the first switching transistor is put in an OFF state in the first period, and the output current of the driving transistor is adjusted in a second period by changing a potential of a second terminal of the first capacitor or a potential of the reference potential terminal of the driving transistor.

8. The display device according to claim 7, further comprising a second capacitor through which the current output terminal of the driving transistor and the data wire are connected.

9. The display device according to claim 8, wherein the second terminal of the first capacitor is connected to a first wire.

10. The display device according to claim 7, further comprising a fourth switching and a second capacitor through both of which the current output terminal of the driving transistor and the data wire are connected.

11. The display device according to claim 10, wherein the second terminal of the first capacitor is connected to a first wire.

12. The display device according to claim 7, further comprising:

a fifth switching transistor provided between the reference potential terminal of the driving transistor and the data wire; and a sixth switching transistor provided between the reference potential terminal of the driving transistor and a power supply wire for supplying a power supply potential which generates the output current of the driving transistor.

13. The display device according to claim 7, further comprising:

a third capacitor provided between the second terminal of the first capacitor and the power supply wire for supplying a power supply potential which generates the output current of the driving transistor; and a seventh switching transistor provided between the second terminal of the first capacitor and the data wire.

14. The display device according to claim 7, further comprising:

an eighth switching transistor provided between the second terminal of the first capacitor and a second wire for supplying a predetermined potential; and a seventh switching transistor provided between the second terminal of the first capacitor and the data wire.

15. A method for driving a display device which includes:

an electro-optic element, being a current-driven type, which serves as a display light source;

a driving transistor for supplying an output current from a current output terminal to the electro-optic element as a driving current for driving the electro-optic element, the output current being controlled by a voltage which is applied between a current control terminal and a reference potential terminal;

a first switching transistor;

a second switching transistor; and a first capacitor, the electro-optic element and the driving transistor being disposed in each of a plurality of pixels which are aligned in a matrix manner, and the driving current corresponding to display data supplied from a data wire to the pixel, wherein:

the driving transistor, the first switching transistor, and the electro-optic element are serially connected, and the current control terminal of the driving transistor is connected to a first terminal of the first capacitor, and the second switching transistor is provided between the current control terminal and the current output terminal of the driving transistor, said method comprising the steps of:

putting the second switching transistor in an ON state and putting the first switching transistor in an OFF state in a first period which starts from or coincides with a time when a potential corresponding to display data of the pixel is supplied from the data wire to the current control terminal of the driving transistor and a corresponding charge is stored in the first capacitor; and adjusting the output current of the driving transistor by changing a potential of a second terminal of the first capacitor or a potential of the reference potential terminal of the driving transistor in a second period.

* * * * *